US007120376B2

(12) United States Patent
Saito et al.

(10) Patent No.: US 7,120,376 B2
(45) Date of Patent: Oct. 10, 2006

(54) IMAGE FORMING APPARATUS FEATURING A FOUR-STEP IMAGE BEARING MEMBER CONTROLLER

(75) Inventors: Masanobu Saito, Shizuoka-ken (JP); Kazuhiro Okubo, Mishima (JP); Minoru Matsuguma, Susono (JP); Jun Haruna, Shizuoka-ken (JP); Kazuhisa Maruyama, Sagamihara (JP); Yoshihiro Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 10/919,401

(22) Filed: Aug. 17, 2004

(65) Prior Publication Data

US 2005/0063734 A1 Mar. 24, 2005

(30) Foreign Application Priority Data

Aug. 20, 2003 (JP) ..... 2003-208004

(51) Int. Cl.
*G03G 15/00* (2006.01)
*G03G 21/00* (2006.01)

(52) U.S. Cl. ..... 399/167; 399/350

(58) Field of Classification Search ..... 399/71, 399/101, 167, 343, 350
See application file for complete search history.

(56) References Cited

U.S. PATENT DOCUMENTS

| | | | | |
|---|---|---|---|---|
| 3,891,846 A | | 6/1975 | Ito | 250/324 |
| 4,218,131 A | | 8/1980 | Ito et al. | |
| 4,323,306 A | | 4/1982 | Ito et al. | |
| 4,806,968 A | | 2/1989 | Watanabe et al. | |
| 6,128,462 A | * | 10/2000 | Kato et al. | 399/350 |
| 6,487,387 B1 | * | 11/2002 | Kusaba et al. | 399/302 |
| 2002/0034401 A1 | | 3/2002 | Yanagida | 399/167 |
| 2003/0020746 A1 | | 1/2003 | Chen et al. | 345/741 |

FOREIGN PATENT DOCUMENTS

| | | |
|---|---|---|
| JP | 58-192056 | 11/1983 |
| JP | 60-128463 | 7/1985 |

(Continued)

OTHER PUBLICATIONS

Patent Abstracts of Japan, Publication No. 58192056, Nov. 9, 1983.

(Continued)

*Primary Examiner*—Sandra L. Brase
(74) *Attorney, Agent, or Firm*—Fitzpatrick, Cella, Harper & Scinto

(57) ABSTRACT

An image forming apparatus for forming an image on a recording material, includes a rotatable image bearing member; a developing member for developing a latent image formed on the image bearing member; a cleaning blade for removing a developer from the image bearing member, the cleaning blade being cooperative with the image bearing member to form a nip in which the cleaning blade is contacted to the image bearing member within a predetermined area; and a controller for executing a first step of stopping rotation of the image bearing member after completion of an image forming operation for forming an image on the recording material; a second step of rotating, after the first step, the image bearing member through a predetermined peripheral distance in a rotational direction which is the same as a direction in which the image bearing member is rotated during the image forming operation; a third step of rotating, after the second step, the image bearing member in a rotational direction which is opposite the direction in which the image bearing member is rotated during the image forming operation; and a fourth step of stopping rotation of the image bearing member after the third step.

18 Claims, 17 Drawing Sheets

FOREIGN PATENT DOCUMENTS

| | | | |
|---|---|---|---|
| JP | 61-67056 | | 4/1986 |
| JP | 61-240276 | * | 10/1986 |
| JP | 04-090585 | * | 3/1992 |
| JP | 8-63071 | | 3/1996 |
| JP | 11-024521 | * | 1/1999 |

OTHER PUBLICATIONS

Patent Abstracts of Japan, Publication No. 60128463, Jul. 9, 1985.

Patent Abstracts of Japan, Publication No. 61067056, Apr. 7, 1986.

* cited by examiner

COMP. EXAMPLE 3 < FORWARD ROT.a → BACKWARD ROT.b → STOP >

CONVENTIONAL < FORWARD ROT.a → BACKWARD ROT.b >

$$SF1 = \frac{(MXLIG)^2}{AREA} \times \frac{\pi}{4} \times 100$$

$$SF\text{-}2 = \frac{(PERI)^2}{AREA} \times \frac{1}{4\pi} \times 100$$

IMAGE FORMING APPARATUS FEATURING A FOUR-STEP IMAGE BEARING MEMBER CONTROLLER

FIELD OF THE INVENTION AND RELATED ART

The present invention relates to an electrophotographic image forming apparatus, such as a copying machine, a printer, etc., for forming an image. In particular, it relates to image forming apparatus employing one of the methods for removing the developer remaining on the image bearing member of the image forming apparatus, such as a latent image bearing member (for example, electrophotographic photosensitive drum, electrostatically recordable dielectric member, etc.), or an intermediary transferring member, by placing an elastic or flexible cleaning member such as a cleaning blade in contact with the image bearing member, intermediary transferring member, or the like, and also, it relates to the methods for controlling the driving of the image bearing member.

In the field of an electrophotographic image forming apparatus, various cleaning apparatuses have been known, which are for removing the developer remaining on the image bearing member after the transfer of the developer image(s) borne on the image bearing member, in order to repeatedly use the image bearing member (for an electrophotographic image forming apparatus), such as an electrophotographic photosensitive drum, an intermediary transferring member (which temporarily holds developer image(s) transferred thereon, and from which developer image(s) are transferred onto recording medium), etc.

One of the most widely used methods for cleaning an image bearing member is the cleaning method which employs a cleaning blade. According to this cleaning method, a flexible (elastic) blade as a cleaning member is placed in contact with an image bearing member with the application of a predetermined amount of pressure in order to remove the residual developer on the image bearing member, by scraping the peripheral surface of the image bearing member. For cleaning efficiency, a cleaning blade is usually placed in contact with the peripheral surface of an image bearing member so that the cleaning edge of the cleaning blade counters the movement of the peripheral surface of the image bearing member in the normal direction, or the direction in which the image bearing member is rotated for image formation.

An image forming apparatus employing a blade-based cleaning method such as the above-described one has been known to have the following problem. That is, while the image forming apparatus is not in operation (while image bearing member is not rotated), the portion of the image bearing surface of the image bearing member, which is in contact with the cleaning blade, becomes different in the level of slipperiness (coefficient of friction) from the rest of the image bearing surface of the image bearing member. This difference in slipperiness between the two portions of the image bearing surface of the image bearing member results in the formation of a streaky image, an image having parallel blurry strips, etc., (attributable to density difference, etc.), during the following image formation job.

In the contact area (nip) between the peripheral surface of the photosensitive drum and cleaning blade, the developer particles and/or external additive particles, etc., which are small in diameter, are compressed by the cleaning blade against the peripheral surface of the photosensitive drum. Thus, while the photosensitive drum is not rotating, they are agglomerated and adhered to the peripheral surface of the photosensitive drum, making thereby the portion of the peripheral surface of the photosensitive drum in the contact area (nip) smaller in coefficient of friction than the rest of the peripheral surface of the photosensitive drum.

As a result, the peripheral velocity of the image bearing member becomes unstable; during the period in which the portion of the peripheral surface of the photosensitive drum, which was reduced in coefficient of friction, is moved past the cleaning blade, the peripheral velocity of the photosensitive drum temporarily increases. This fluctuation in the peripheral velocity of the photosensitive drum results in the formation of an image having parallel blurry strips (different in density from the adjacent areas), the interval of which corresponds to the rotational cycle of the image bearing member.

As the image forming apparatus is repeatedly rotated, the coefficient of friction of the portion of the image bearing surface of the photosensitive drum, which was reduced in coefficient of friction for the above-described reason, eventually increases to the same level as that of the coefficient of the friction of the portions adjacent thereto. However, the number of times the image bearing member is rotated during a so-called "pre-rotation period" is not large enough for the coefficient of friction of the aforementioned portion of the image bearing surface of the photosensitive drum to increase to the level of the coefficient of friction of the portions adjacent thereto. Normally, the number of times the image bearing member is rotated during a "pre-rotation period" is four or five. In order for the coefficient of friction of the aforementioned portion to recover to the same levels as those of the portions adjacent thereto, the image bearing member must be rotated no less than 10 times; normally, it takes roughly 16 times. Generally, four full rotations of the image bearing member are equivalent to the size of a single recording medium of the standard size. Thus, in the case of the first copy, or the copy printed immediately after the pre-rotation, the aforementioned image defects (parallel blurry strips) are rather conspicuous, but in the case of the third to fourth copy, the are more or less inconspicuous.

The formation of the images suffering from the above-described parallel blurry strips is more frequent in the case of an image forming apparatus of the so-called tandem type, in which two or more (four, for example) photosensitive drums are disposed in parallel, in particular, a tandem type image forming apparatus of a single-motor type, that is, an image forming apparatus in which two or more (four, for example) photosensitive drums are disposed in parallel and are driven by a single motor.

This is for the following reason. That is, in the case of a tandem type image forming apparatus, the multiple photosensitive drums synchronize in the timing with which the portion of the peripheral surface of each photosensitive drum, the coefficient of friction of which has been reduced, is moved past the cleaning blade. Therefore, they synchronize in the timing with which the torque (load) necessary to rotationally drive a photosensitive drum changes. Consequently, the changes in the amount of the load borne by the entirety of the system for driving the multiple photosensitive drums is amplified by the number of the photosensitive drums which must be driven by the photosensitive member driving system. As a result, the portions of a latent image written on the portion of the peripheral surface of each photosensitive drum, the coefficient of friction of which has been reduced, appear blurry as the latent image is developed. In other words, an image having parallel blurry strips (smeared areas) is yielded. This phenomenon occurs more frequently when forming an image having halftone areas.

The most reliable method for completely eliminating this problem is to keep the cleaning blade retracted from the surface of an image bearing member while the image forming apparatus is kept on standby. This, however, incurs the cost for providing an image forming apparatus with a mechanism for temporarily retracting a cleaning blade. In addition, the provision of a cleaning blade retracting mechanism makes it very difficult to place, and keep, a cleaning blade in contact with the peripheral surface of an image bearing member at a high level of accuracy. Moreover, in order to prevent the problem that some areas of the peripheral surface of the image bearing member fail to be cleaned, the portion of the peripheral surface of the image bearing member with which the cleaning blade is placed in contact after its retraction must be such a portion of the peripheral surface of the image bearing member that had already been cleaned before the cleaning blade was retracted.

Japanese Laid-open Patent Application 8-063071 discloses a method for removing the developer having agglutinated in the adjacencies of the edge of the contact area between a cleaning blade and an image bearing member, by briefly rotating in reverse the image bearing member during the interval between two printing jobs.

FIG. 11 is a drawing for describing the method, in accordance with the prior art, for preventing the aforementioned problem. It is an enlarged schematic sectional view of the cleaning edge of a cleaning blade, and its adjacencies. Designated by a referential symbol 1 in the drawing is an image bearing member, and designated by a referential symbol 6*a* is a cleaning blade formed of rubber. Designated by a referential symbol W is the contact area between the cleaning blade 6*a* and photosensitive drum 1. FIG. 11(1) shows the shape of the cleaning edge portion of the cleaning blade 6*a* while an image is being formed, in other words, while the image bearing member is driven in the normal direction for image formation, that is, the direction indicated by an arrow mark a. In this case, the cleaning blade 6*a* is kept pressed against the peripheral surface of the image bearing member 1, with the application of a predetermined amount of pressure, being tilted so that during an image forming operation, the cleaning edge of the cleaning blade 6*a* counters the movement of the peripheral surface of the image bearing member in the normal direction. Therefore, the friction between the cleaning edge of the cleaning blade 6*a* and the peripheral surface of the image bearing member drags the cleaning edge portion of the cleaning blade 6*a*, into the nip (contact area), deforming thereby the cleaning edge. Therefore, it is assured that the cleaning edge of the cleaning blade 6*a* remains perfectly in contact with the peripheral surface of the image bearing member. As a result, the peripheral surface of the image bearing member is wiped clean by the cleaning edge; the residual developer on the peripheral surface of the image bearing member is scraped away by the cleaning edge of the cleaning blade 6*a*, which is in contact with the peripheral surface of the image bearing member.

As the image bearing member is rotated, the residual developer on the peripheral surface of the image bearing member is scraped loose by the cleaning blade 6*a*, piling up at the upstream edge of the contact area between the cleaning edge of the cleaning blade 6*a* and the peripheral surface of the image bearing member, in terms of the rotational direction of the image bearing member. If the rotation of the image bearing member is stopped after a substantial amount of the residual developer has piled up, the piled up residual developer becomes agglutinated and bonded to the peripheral surface of the image bearing member. The strength of this bond between the piled up residual developer and the peripheral surface of the image bearing member sometimes is large enough to enable the residual developer having agglutinated and adhered to the peripheral surface of the image bearing member, to move past the cleaning edge of the cleaning blade 6*a* during the startup period of the next image formation job, in which the image bearing member is rotated in the normal direction. In other words, if the strength of the bond between the residual developer remaining on a given portion of the image bearing surface of the image bearing member and the given area is large enough as described above, the given portion becomes lower in coefficient of friction than the rest of the peripheral surface of the image bearing member.

Next, referring to FIG. 11(2), according to the prior art for preventing the above-described problem, before stopping the rotation of the image bearing member in the normal direction, the small lump of residual developer having accumulated on the immediately upstream side of the cleaning edge of the cleaning blade is moved away from the cleaning edge, by temporarily rotating the image bearing member in reverse (indicating by arrow mark b, that is, direction opposite to normal direction).

However, the method, in accordance with the prior art, which temporarily rotates the image bearing member in reverse (arrow b direction) immediately after the image forming rotation of the image bearing member in the normal direction is stopped, had the following problem. That is, the lump of the combination of the accumulated developer and/or external additive t agglutinates. Therefore, when the image bearing member is rotated next time in the normal direction, the lump of the agglutinated combination moves past the cleaning edge of the cleaning blade 6*a*.

SUMMARY OF THE INVENTION

The primary object of the present invention is to provide an image forming apparatus capable of preventing the developer from being agglutinated on the image bearing member by the cleaning blade, and a method for controlling the driving of the image bearing member of such an image forming apparatus.

Another object of the present invention is to provide an image forming apparatus in which the amount of the torque necessary to rotate the image bearing member(s) does not fluctuate, and a method for controlling the driving of the image bearing member of such an image forming apparatus.

Another object of the present invention is to provide an image forming apparatus which does not form an image defective in that it has parallel blurry strips, and a method for controlling the driving of the image bearing member of such an image forming apparatus.

Another object of the present invention is to provide an image forming apparatus capable of preventing the formation of an image having the parallel blurry strips, without requiring a mechanism for temporarily moving the cleaning blade away from the image bearing member, and a method for controlling the driving of the image bearing member of such an image forming apparatus.

According to an aspect of the present invention, there is provided an image forming apparatus for forming an image on a recording material, said apparatus comprising a rotatable image bearing member; a developing member for developing a latent image formed on said image bearing member; a cleaning blade for removing a developer from said image bearing member, said cleaning blade being cooperative with said image bearing member to form a nip in which said cleaning blade is contacted to said image bearing member within a predetermined area; and a controller for executing a first step of stopping rotation of said image bearing member after completion of an image forming operation for forming an image on the recording material; a second step of rotating, after said first step, said image bearing member through a predetermined peripheral distance in a rotational direction which is the same as a direction in which said image bearing member is rotated during the image forming operation; a third step of rotating, after said second step, said image bearing member in a rotational direction which is opposite the direction in which said image bearing member is rotated during the image forming operation; and a fourth step of stopping rotation of said image bearing member after said third step.

According to another aspect of the present invention, there is provided a control method for an image bearing member for an image forming apparatus for forming an image on a recording material, said image forming apparatus including said image bearing member, a developing member for developing a latent image formed on said image bearing member, a cleaning blade for removing a developer from said image bearing member, said cleaning blade being cooperative with said image bearing member to form a nip in which said cleaning blade is contacted to said image bearing member within a predetermined area, said method comprising a first step of stopping rotation of said image bearing member after completion of an image forming operation for forming an image on the recording material; a second step of rotating, after said first step, said image bearing member through a predetermined peripheral distance in a rotational direction which is the same as a direction in which said image bearing member is rotated during the image forming operation; a third step of rotating, after said second step, said image bearing member in a rotational direction which is opposite the direction in which said image bearing member is rotated during the image forming operation; and a fourth step of stopping rotation of said image bearing member after said third step.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

(1) Example of Image Forming Apparatus

Figure 1:
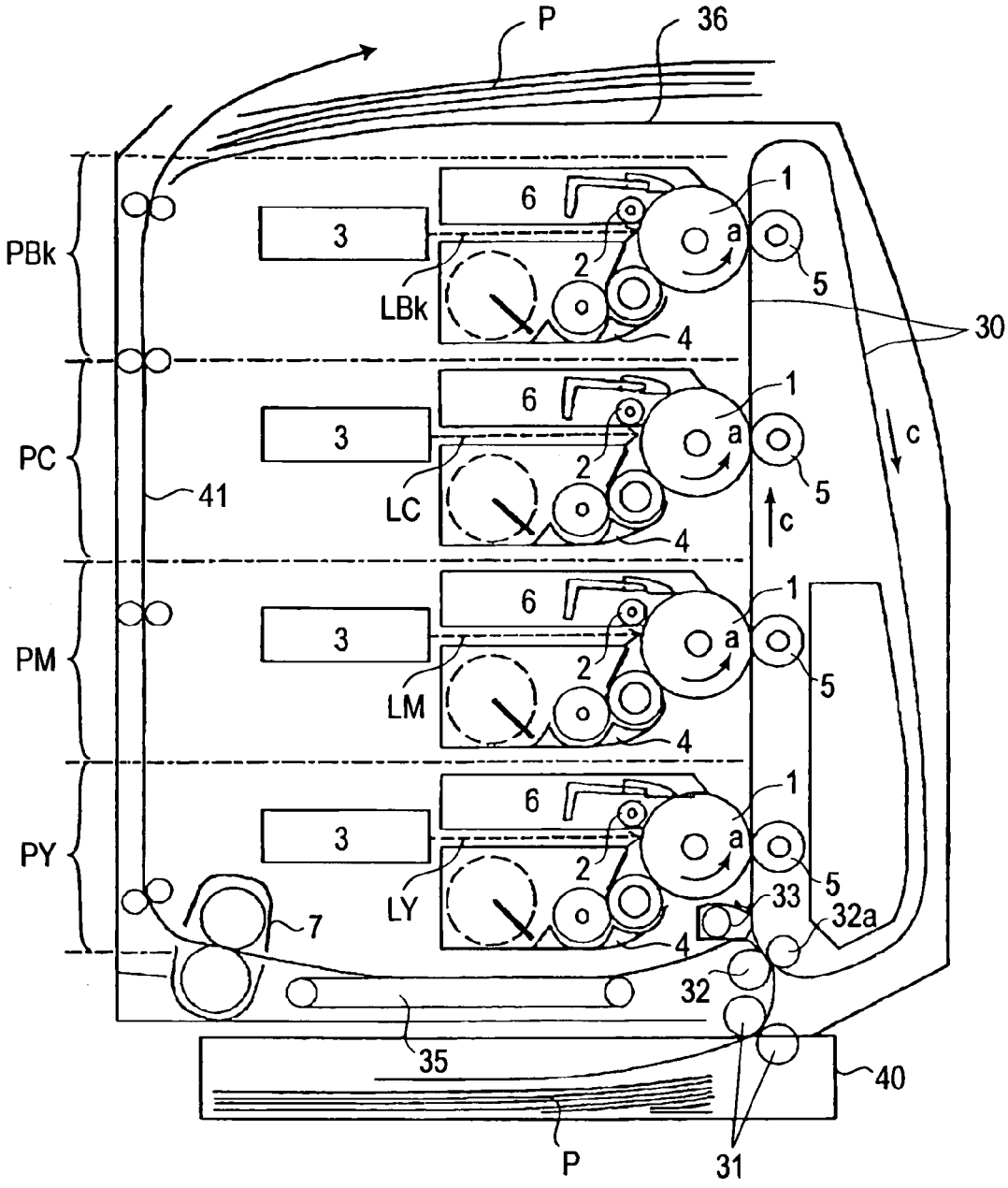
FIG. 1 is a schematic sectional view of the image forming apparatus in the first embodiment of the present invention, showing the general structure thereof.

FIG. 1 is an example of an image forming apparatus in accordance with the present invention. The image forming apparatus in this embodiment is of a tandem type, in which two or more (four) photosensitive drums as image bearing members (latent image bearing members) are vertically aligned in parallel. It is an electrophotographic color (multicolor) printer employing an intermediary transfer belt.

PY, PM, PC, and PBk designate four (first to fourth) image formation stations (image formation units) for forming yellow (Y), magenta (M), cyan (C), and black (Bk) toner images, respectively, which are vertically stacked in parallel, listing from the top, in the main assembly of the image forming apparatus.

These four image formation stations, that is, first to fourth image formation stations PY, PM, PC, and PBk, are identical in structure and electrophotographic image formation function, except for the color of the toner image they form. More specifically, each of the first to fourth image formation stations comprises: an electrophotographic photosensitive member in the form of a drum 1 (photosensitive drum) as a first image bearing member; a charge roller 2 as a first charging means; a laser beam projecting apparatus 3 as an exposing means; a toner-based developing apparatus 4 as a developing means; a primary transfer roller 5 as a first transferring means; a blade-based cleaning apparatus 6 as a cleaning means; etc. The developers stored in the developing apparatuses in the first to fourth image formation stations are yellow, magenta, cyan, and black toners, respectively. The toner in each color developer is particulate, and is 6 μm in average particle diameter. The external additive of each color developer is silica.

The image forming apparatus in this embodiment employs one of the process cartridge systems. In other words, each of the first and fourth image formation stations PY, PM, PC, and PBk is in the form of a process unit (process cartridge), which comprises a cartridge removably mountable in the main assembly of the image forming apparatus, and four processing devices, namely, the photosensitive drum 1, charge roller 2, developing apparatus 4, and blade-based cleaning apparatus 6, which are integrally placed in the cartridge.

Designated by a referential number 30 is an intermediary transferring member, in the form of an endless belt, as a second image bearing member, which is located on the photosensitive drum side of each of the first to fourth image formation portions PY, PM, PC, and PBk, that is, the front side of the printer, being stretched around unshown multiple support rollers so that it vertically stretches from virtually the bottom to top ends of the apparatus main assembly, that is, from the location corresponding to the image formation station PY to the location corresponding to the image formation station PBk. In each of the first to fourth image formation stations, a primary transfer roller 5 is kept pressed against the photosensitive drum 1 with the intermediary transfer belt 30 pinched between the primary transfer roller 5 and photosensitive drum 1. In other words, the contact area between the photosensitive drum 1 and intermediary transfer belt 30 is the primary transfer station.

Figure 2:
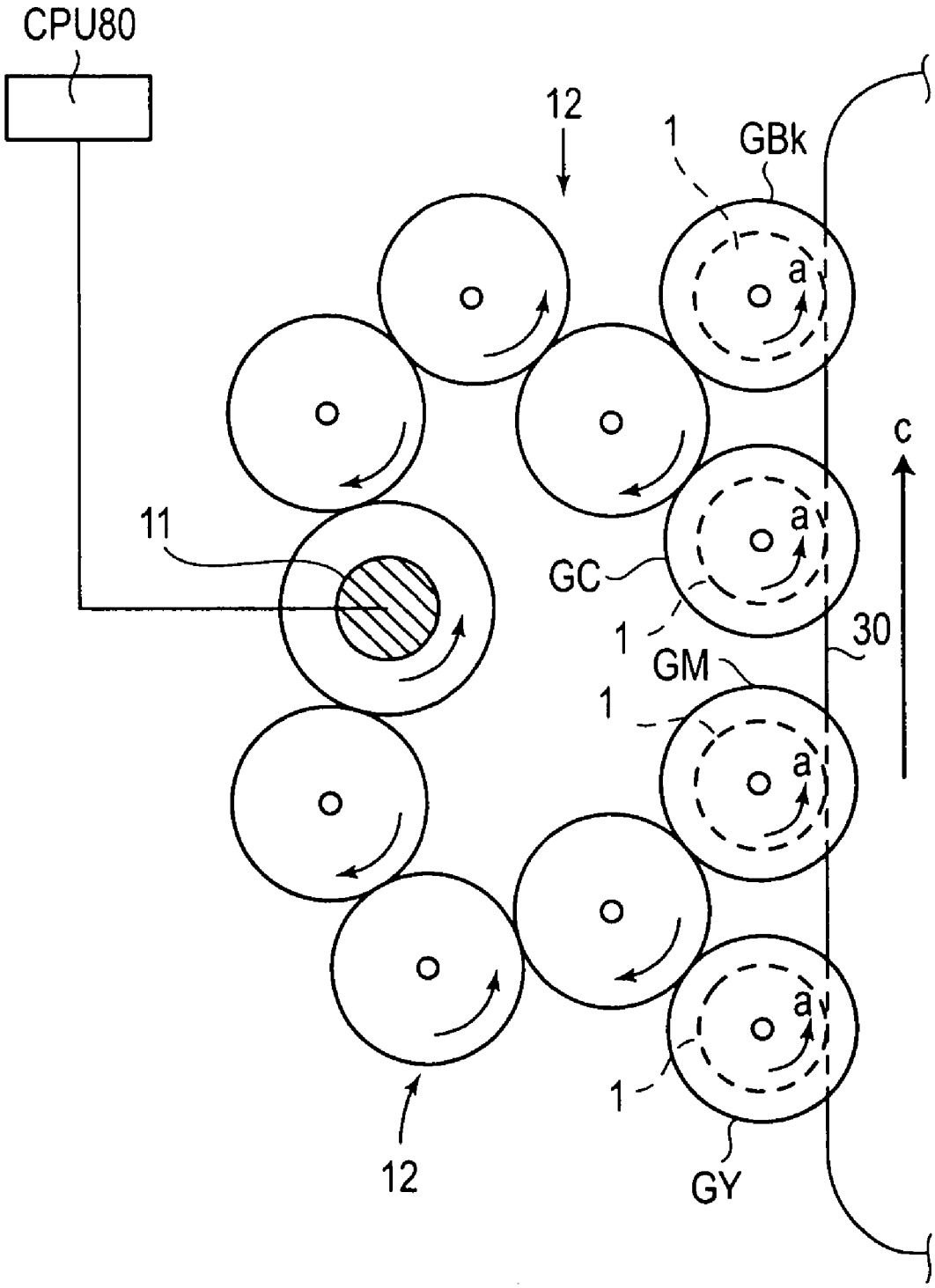
FIG. 2 is a schematic drawing of the "single motor type" driving system for driving four photosensitive drums.

Referring to FIG. 2, the method for driving the photosensitive drum 1 of each of the first to fourth image formation stations PY, PM, PC, and PBk in the image forming apparatus in this embodiment is one of the so-called "single motor system", which drives the four photosensitive drums 1 with the use of only one motor, or the motor 11. Not only does a single motor system requires only a motor, as a driving force source, which is relatively costly, but also, only a single control system (mechanism for detecting rotational speed of each motor, mechanism for controlling each motor). Therefore, generally, a single motor system is advantageous in terms of cost. In other words, the image forming apparatus in this embodiment is provided with only a single driving force source, or the motor 11, and the driving force from the motor 11 is transmitted through a gear train 12 to drum gears GY, GM, GC, and GBk of the photosensitive drums 1 of the first to fourth image formation stations, rotating the four photosensitive drums 1 in synchronism.

A CPU 80 (computer) controls the overall operational sequence for the image formation. The motor 11 is also controlled by this CPU 80; it is driven forward, or in reverse, or kept still (stopped). As the motor 11 is rotated forward, that is, in the normal direction, the four photosensitive drums are rotated in the normal direction, that is, the counterclockwise direction, indicated by the arrow mark a in FIGS. 1 and 2, whereas as the motor 11 is rotated in reverse, the four photosensitive drum are rotated in reverse. Further, as the motor 11 is stopped, the four photosensitive drums 1 stop rotating.

As the CPU 80 receives an image formation trigger (printing job start signal), it sends to the driver of the motor 11 a signal for starting the rotation of the motor in the normal direction. As a result, the motor 11 is rotated in the normal direction, rotating thereby each of the four photosensitive drums of the first to fourth image formation stations in the normal direction, that is, the counterclockwise direction indicated by the arrow a in FIGS. 1 and 2, at a peripheral velocity of 100 mm/sec, for example.

Further, the CPU 80 activates the unshown mechanism for driving the intermediary transfer belt 30, causing the mechanism to circularly rotate the belt 30 in the direction c, in the clockwise direction indicated by an arrow mark c, that is, the same direction as the normal rotational direction a of each photosensitive drum 1, at roughly the same peripheral velocity as that of the photosensitive drum 1.

In each of the first to fourth image formation stations PY, PM, PC, and PBk, as the photosensitive drum 1 is rotated in the normal direction, it is uniformly charged (primary charging process) to predetermined polarity and potential level by the charge roller 2 to which charge bias is being applied from an unshown power circuit. The charged peripheral surface of the photosensitive drum 1 is exposed to an exposure light, that is, a beam of light (LY, LM, LC, or LBk) emitted from an LED array 3 (exposing apparatus) while being modulated by video signals corresponding to one of the color components (yellow, magenta, cyan, and black) separated from the optical image of an intended full-color image. As a result, an electrostatic latent image reflecting the image formation data is formed on the peripheral surface of each photosensitive drum 1. This electrostatic latent image is developed into a visible image, or an image formed of toner (which hereinafter will be referred to as toner image, or developer image). Consequently, yellow, magenta, cyan, and black toner images, which correspond in color to the four color components separated from the optical image of the intended image through an electrophotographic process, are sequentially formed on the peripheral surfaces of the photosensitive drums 1 in the first to fourth image formation stations PY, PM, PC, and PBk, respectively, with a predetermined sequence control timing.

In the primary transfer station of each of the first to fourth image formation stations PY, PM, PC, and PBk, the image formed on the photosensitive drum 1 is transferred onto the surface of the intermediary transfer belt 30 by the primary transfer bias applied to the primary transfer roller from an unshown power source circuit; the images formed on the photosensitive drums 1 in the first to fourth image formation stations PY, PM, PC, and PBk, one for one, are sequentially transferred in layers onto the intermediary transfer belt 30. As a result, a single full-color toner image (mirror image), which is to be fixed, is composed on the surface of the intermediary transfer belt 30 which is being circularly rotated.

Also in each of the first to fourth image formation stations PY, PM, PC, and PBk, the toner remaining on the photosensitive drum 1 after the transfer (primary transfer) of the toner image onto the intermediary transfer belt 30, is removed by the cleaning blade 6*a* (FIG. 4) of the cleaning apparatus 6, and is stored in the storage portion 6*b* of the cleaning apparatus 6.

Designated by a referential number 32 is a secondary transfer roller. Designated by a referential number 32*a* is a counter roller, which is located at the bottom end of the loop formed by the intermediary transfer belt 30, and inward side of the loop, being kept in contact with the inward surface of the intermediary transfer belt 30 with the intermediary transfer belt 30 pinched between the secondary transfer roller 32 and counter roller 32*a*. The contact area between the secondary transfer roller 32 and intermediary transfer belt 30 is the secondary transfer station.

Designated by a referential number 40 is a sheet feeder cassette, which is located in the bottom portion of the main assembly of the image forming apparatus, and in which a certain number of sheets of transfer mediums P are stored in layers. The transfer medium P is the final medium onto which an image is transferred (recorded). The CPU 80 drives a conveying means 31 (pickup roller) following a predetermined sequence control timing, to convey a required number of the sheets of transfer medium P to the second transfer station, with the predetermined timing, while separating them one by one, from the sheet feeder cassette 40. As each sheet of transfer medium P is conveyed through the secondary transfer station, the unfixed composite full-color toner image on the intermediary transfer belt 30 is transferred onto the surface of the transfer medium P by the secondary transfer bias which is being applied to the secondary transfer roller 32 from an unshown power source circuit.

After being moved through the secondary transfer station, the transfer medium P is separated from the surface of the intermediary transfer belt 30, and is further conveyed by a conveyer belt 35 to a fixing apparatus 7.

The developer remaining on the intermediary transfer belt 30 is removed by the cleaning blade of the blade-based cleaning apparatus 33, and is sent to a waste toner box 34 to be stored therein.

As the transfer medium P bearing the unfixed full-color toner image is conveyed through the fixing apparatus 7, the unfixed full-color toner image is welded to the transfer medium P by the combination of heat and pressure applied by the fixing apparatus 7. Thereafter, the transfer medium P is conveyed through a sheet path 41, and is discharged, as a permanent color copy, into a delivery tray 36 on top of the main assembly of the image forming apparatus.

(2) Image Formation Process of Image Forming Apparatus

Figure 3:
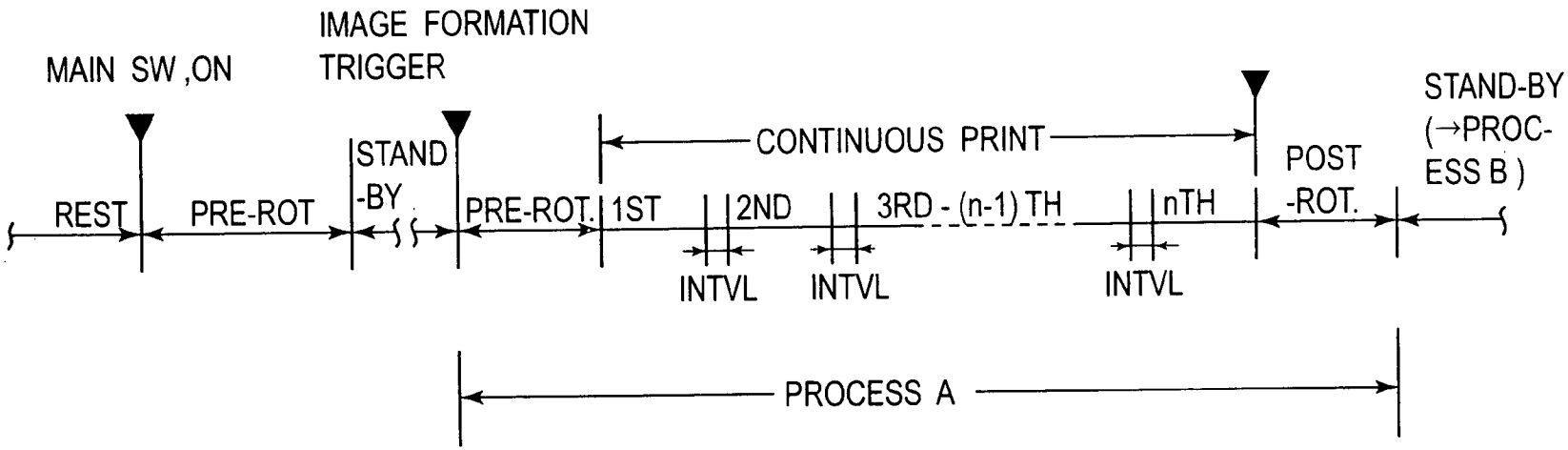
FIG. 3 is a diagram showing the operation of the image forming apparatus in the first embodiment.

FIG. 3 is a diagram showing the image formation process of the image forming apparatus in this embodiment.

1) Primary Pre-Rotation Step

This is the step which comes immediately after the image forming apparatus is turned on, and in which the apparatus is started up (warmed up). More specifically, as the main switch of the image forming apparatus is turned on, the image forming apparatus starts up, readying various processing devices thereof for image formation.

2) Standby Period

After the completion of the preset startup operations, the image forming apparatus goes into the standby state, and remains therein until an image formation trigger (printing job start signal) is inputted.

3) Secondary Pre-Rotation Step

This is the step which is carried out immediately after an image formation trigger is inputted, and in which the image forming apparatus is started up again to ready the various processing devices thereof for image formation.

More specifically, (1) Reception of image formation trigger by image forming apparatus, (2) Development of intended image by formatter (length of formatting time varies depending on amount of data required for formation of intended image, and processing speed of formatter), and (3) Starting of secondary pre-rotation step, are carried out in the listed order.

However, if an image formation trigger is inputted during the primary pre-rotation step in 1), there will be no standby period; the secondary pre-rotation step is carried out immediately after the completion of the primary pre-rotation step.

4) Printing Step

The completion of the predetermined pre-rotation step is immediately followed by the image formation step, and a transfer medium, on which an image has been formed, is outputted.

When the image forming apparatus is set up for continuously forming a predetermined number of copies, the above described image formation process is sequentially repeated until the predetermined number of transfer mediums, on which an image has been formed, are outputted.

5) Recording Medium Interval

This is the period (step) which occurs between the completion of the formation of a given copy among the predetermined number of copies to be formed, and the starting of the formation of the next copy, when the image forming apparatus is set up for continuously forming a predetermined number of copies.

6) Post-Rotation Step

This is a step carried out at the completion of a given printing job. More specifically, after the last transfer medium, in a given continuous printing job, on which an image has been formed, is outputted, the image forming apparatus is continuously driven to allow the processing devices used for the job to carry out their post-job operation. When the given job requires printing of only a single copy, this step is carried out as soon as a single transfer medium, on which an image has been formed, is outputted.

7) Standby Period

After the completion of the predetermined post-rotation, the driving of the image forming apparatus is stopped, and the image forming apparatus is kept on standby until the next image formation trigger is inputted.

The sequence from the pre-rotation step to the post-rotation step makes up a first image formation job A. A second image formation job is started as soon as the next image formation trigger is inputted.

Figure 4:
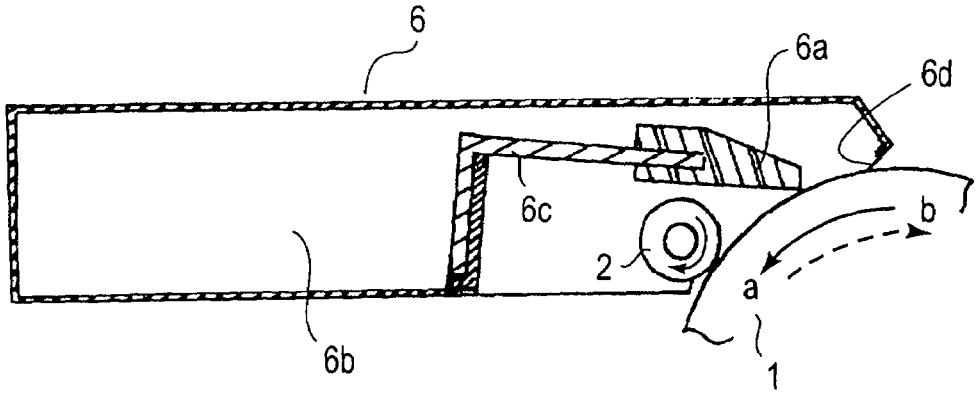
FIG. 4 is an enlarged schematic sectional view of the blade type cleaning apparatus portion of the image forming apparatus in the first embodiment.

(3) Measure for Reducing Load Fluctuation Attributable to Cleaning Blade Left in Contact with Photosensitive Drum FIG. 4 is an enlarged schematic sectional view of the blade-based cleaning apparatus 6, the cleaning blade of which is in contact with the photosensitive drum 1. The cleaning blade 6*a* in this embodiment is formed of foamed urethane with a hardness of 70° (ñ2°) in Wallace hardness scale. Designated by a referential number 6*c* is a supporting member for supporting the cleaning blade 6*a*. The cleaning blade supporting member 6*c* is firmly fixed to the housing of the cleaning apparatus 6 to keep the cleaning edge of the cleaning blade 6*a* pressed on the peripheral surface of the photosensitive drum 1 so that a predetermined amount of contact pressure is maintained between the cleaning edge of the cleaning blade 6*a* and the peripheral surface of the photosensitive drum 1, and also, so that the cleaning blade 6*a* is tilted in the direction to counter the movement of the peripheral surface of the photosensitive drum in the normal direction in which the photosensitive drum 1 is rotated for image formation. In this embodiment, the contact pressure between the cleaning blade 6*a* and photosensitive drum 1 is roughly 70 gf/cm (the amount of the apparent invasion of the cleaning blade 6*a* into the photosensitive drum 1, in terms of the radius direction of the photosensitive drum 1 is 1.2 ñ 0.2 mm).

Designated by a referential number 6*d* is a sealing sheet (squeegeeing sheet) which plays the role of prevent the residual developer from being blown out of the housing of the cleaning apparatus 6 as the residual developer is scraped away from the peripheral surface of the photosensitive drum 1. The sheet 6*d* is placed in contact with the peripheral surface of the photosensitive drum 1 so that the sealing edge of the sheet 6*d* is on the upstream of the cleaning edge of the cleaning blade 6*a*, and on the downstream of the base portion of the sheet 6*d*, in terms of the normal rotational direction a of the photosensitive drum 1. The sheet 6*d* is attached to the edge of the housing of the cleaning apparatus 6, with the use of two-sided adhesive tape or the like. This squeegeeing sheet 6*d* is formed of such flexible sheet as polyethylene terephthalate film, the thickness of which is in the range of 30 μm–100 μm.

As the photosensitive drum 1 is rotated in the normal direction a, the residual developer remaining on the peripheral surface of the photosensitive drum 1 is moved past the squeegeeing sheet 6*d*, is removed from the peripheral surface of the photosensitive drum 1 by the cleaning blade 6*a*, and then, is stored in the storage portion 6*b* of the cleaning apparatus 6. Although the cleaning apparatus 6 is provided with a conveying member for conveying the waste developer removed from the peripheral surface of the photosensitive drum 1 by the cleaning blade 6*a*, into the deeper end of the storage portion 6*b*, this conveying member is not shown in FIG. 4.

Hereinafter, various methods, inclusive of those in accordance with the prior art, for controlling the rotation of the photosensitive drum 1 will be described in relation to the formation of an image suffering from the aforementioned parallel blurry strips.

1) COMPARATIVE EXAMPLE 1

Rotation in Normal Direction—Stop and No Action

Figure 5:
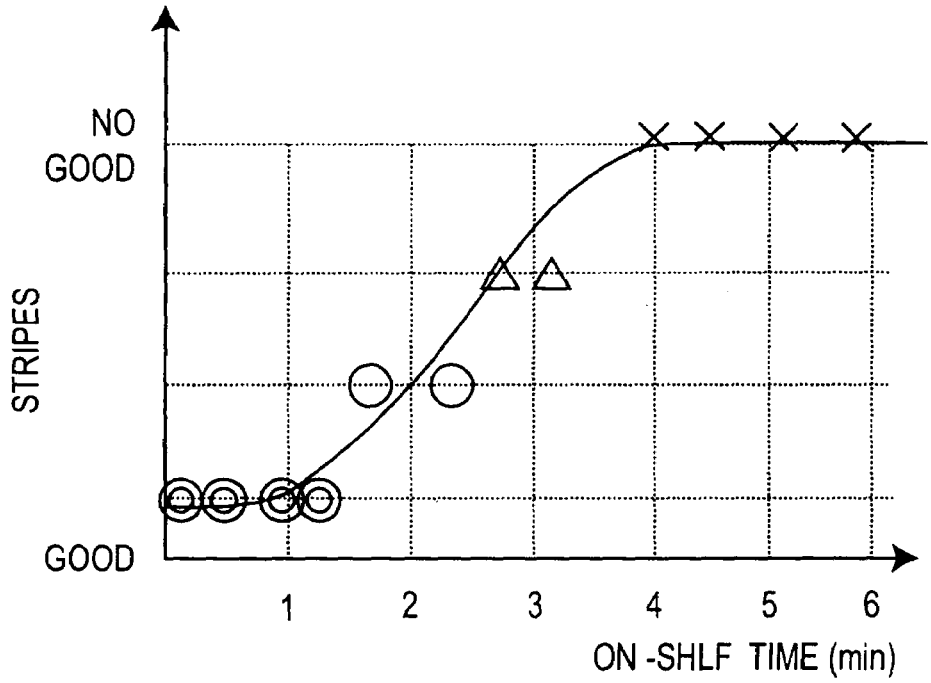
FIG. 5 is a graph showing the relationship between the length of time the image bearing member is not rotate, and the level of conspicuousness of the parallel blurry strips of an defective image, in the first comparative example.

FIG. 5 is a graph showing the relationship between the length of time the cleaning blade is left in contact with the peripheral surface of the photosensitive drum 1 after the completion of the rotation of the photosensitive drum 1 in the normal direction a for printing, and the evaluation of the images, in terms of stripy defects. The images formed for the evaluation were halftone images, and were formed after the image forming apparatus was kept on standby for one to six seconds. The evaluation is made based on the first halftone image formed after the image forming apparatus was kept on stand by for each of the predetermined lengths of time. The conspicuousness of the parallel blurry strips of an image attributable to the problem that a portion of the residual developer having been agglomerated on the peripheral surface of the photosensitive drum 1 by the cleaning blade during the normal rotation, that is, image forming rotation, of the photosensitive drum 1, agglutinates and adheres to the peripheral surface of the photosensitive drum 1 while the cleaning blade is left in contact with the peripheral surface of the photosensitive drum 1 during a standby period of the image forming apparatus, agglutinates and adheres to the peripheral surface of the photosensitive drum 1, and then, moves past the cleaning blade as the photosensitive drum 1 is rotated in the normal direction for image formation, in the following print job, was evaluated based on the following criteria.

*: no strips
*: parallel strips are faintly visible upon close inspection
*: parallel strips are visible
*: parallel strips are conspicuous.

The axis of abscissas represents the length of time the photosensitive drum was not being rotated, and the axis of ordinates represents the level of the conspicuousness of parallel strips. It is evident from this graph that the parallel strips were formed when the photosensitive drum 1 was not rotated for no less than 2–3 minutes. The portion of the peripheral surface of the photosensitive drum 1 corresponding in position to the parallel strips of an image was covered with the lumps of agglutinated developer and/or external additives. Therefore, it is reasonable to conclude that the longer the length of time the photosensitive drum 1 is not rotated, the higher the levels of the strength of the adhesion of the agglutinated residual developer to the peripheral surface of the photosensitive drum 1.

Figure 6:
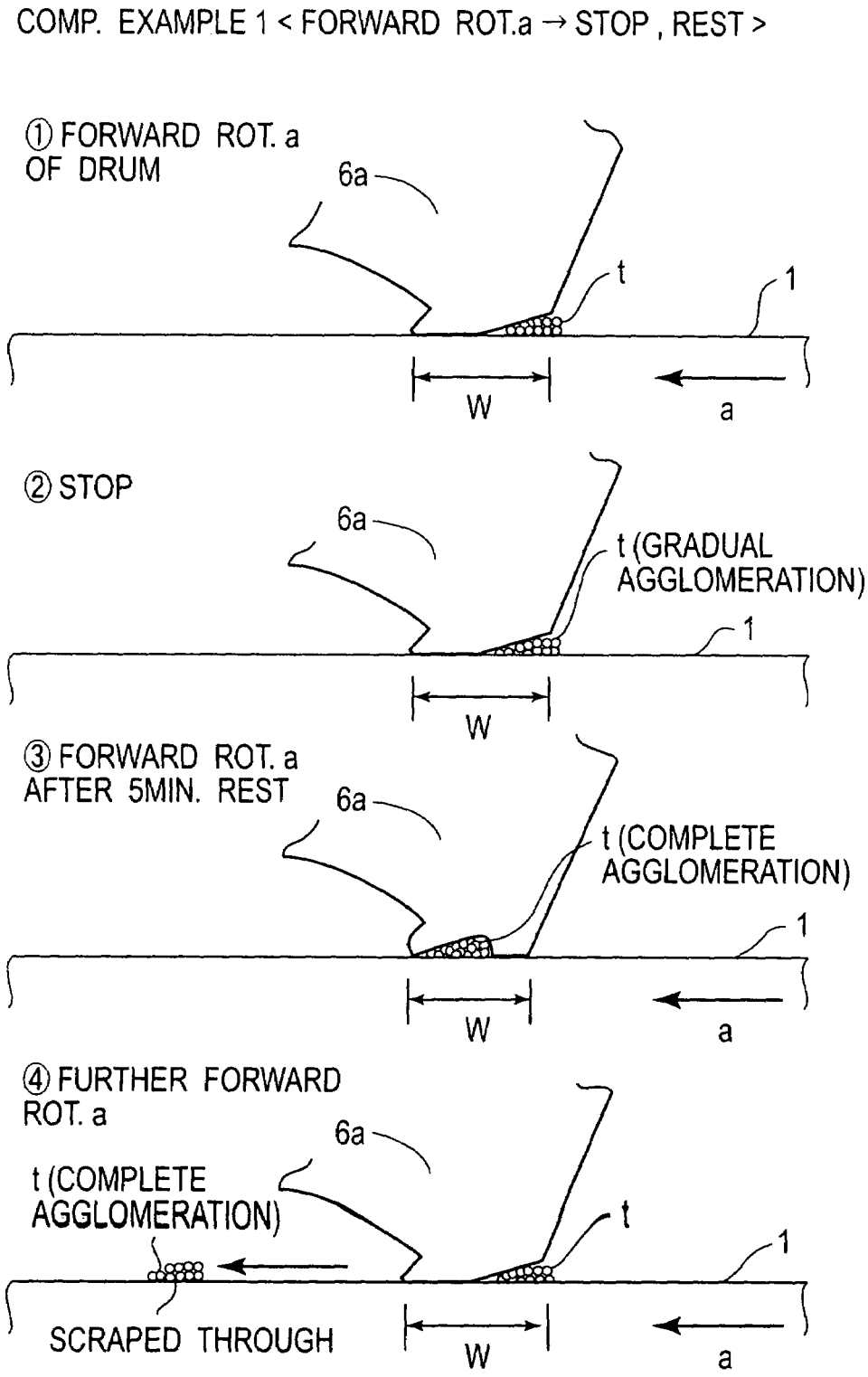
FIG. 6, consisting of parts (1) through (4), is a schematic sectional view of the contact area, and its adjacencies, between the cleaning edge of the cleaning blade and the peripheral surface of the image bearing member, in the first comparative example, showing the changes in the state of the cleaning edge, which is caused by the image bearing member rotation control carried out immediately after the completion of a given image forming job.

Regarding the control sequence (rotation in normal direction a—stop and no action) of the rotation of the photosensitive drum 1, FIG. 6 is a schematic sectional view of the contact area W between the cleaning blade 6*a* and photosensitive drum 1, showing what occurs in the contact area W and its adjacencies when no action is taken after the image forming rotation of the photosensitive drum is ended.

FIG. 6(1) shows the state of the contact area W during the normal rotation a of the photosensitive drum 1. In this state, the cleaning edge of the cleaning blade 6*a* remains deformed. This deformation of the cleaning edge occurs because the cleaning blade 6*a* is placed in contact with the peripheral surface of the photosensitive drum 1 so that the cleaning edge of the cleaning blade 6*a* counters the movement of the peripheral surface of the photosensitive drum 1 in the normal direction a for image formation, and therefore, the cleaning edge is dragged into the contact area W by the peripheral surface of the photosensitive drum 1 as the photosensitive drum 1 is rotated in the normal direction a.

Therefore, as the residual developer and/or the external additive t is scraped away (removed) from the peripheral surface of the photosensitive drum 1, a certain portion of the removed residual developer and/or external additive t is likely to enter and/or remain in the gap between the deformed cleaning edge and the peripheral surface of the photosensitive drum 1.

FIG. 6(2) shows the state of the contact area W in which the photosensitive drum 1 is not rotating. While the photosensitive drum 1 is standing still, the developer and/or external additive t having collected between the blade 6*a* and photosensitive drum 1 is compressed by the deformed cleaning edge of the cleaning blade 6, being thereby gradually agglutinated, while it is let unattended there. It is also evident from the graph in FIG. 5 that as long as the length of time the photosensitive drum 1 is not rotated is no more than 1 minute, the cleaning edge of the blade 6*a* remains the same in shape, and therefore, the agglutination of the developer and/or external additive t does not become too serious for the lump of developer and/or external additive t to be removed, and also, that as the lump of developer and/or external additive t is left unattended no less than 2–3 minutes, the adhesion of the developer and/or external additive t to the photosensitive drum 1 becomes firmer, making it more difficult to remove the developer and/or external additive t from the peripheral surface of the photosensitive drum 1.

FIG. 6(3) shows the state of the contact area W immediately after the second printing operation B was started (photosensitive drum 1 began to be rotated in normal direction a) after the photosensitive drum 1 was not rotated for five minutes. In this state, the developer and/or external additive t had completely agglutinated and adhered to the photosensitive drum 1 while the photosensitive drum 1 was not rotated, and therefore, the developer and/or external additive t moved past the cleaning edge of the blade 6*a* as the photosensitive drum 1 was rotated in the normal direction a for the image formation in the second print job B.

FIG. 6(4) shown the state of the contact area W immediate after the developer and/or external additive t having agglutinated and adhered to the photosensitive drum 1 has moved past the blade 6. This lump of developer and/or external additive t having agglutinated and adhered to the photosensitive drum 1 comes back to the cleaning blade 6*a* as the photosensitive drum 1 is rotated one full turn. Then, as the photosensitive drum 1 is rotated further, the developer and/or external additive t moves past the cleaning blade 6*a*. The portion of the peripheral surface of the photosensitive drum 1, to which the agglutinated developer and/or external additive t had adhered, is different in coefficient of friction from the rest of the peripheral surface of the photosensitive drum 1. Therefore, while this portion is moving through the contact area W, the load borne by the system for driving the photosensitive drum 1 is different from that while the rest is moved through the contact area W. Therefore, the portions of the latent image corresponding to this portion of the peripheral surface of the photosensitive drum 1 becomes blurred, resulting in the formation of a defective image, defective in that it suffers from parallel blurry strips.

It became evident from the testing of this first example of comparison that as long as the length of time the photosensitive drum 1 was not rotated after the rotation of the photosensitive drum 1 in the normal direction a was stopped was no more than 1 minute, the blade 6*a* remained in the shape into which it was deformed, and therefore, the strength with which the developer and/or external additive t having collected between the deformed blade 6*a* and the peripheral surface of the photosensitive drum 1 was agglutinated and adhered to the photosensitive drum 1 by the cleaning edge of the blade 6*a* was not large enough to allow the lumps of residual developer and/or external additive t to move past the cleaning blade 6*a*.

2) COMPARATIVE EXAMPLE 2

Figure 7:
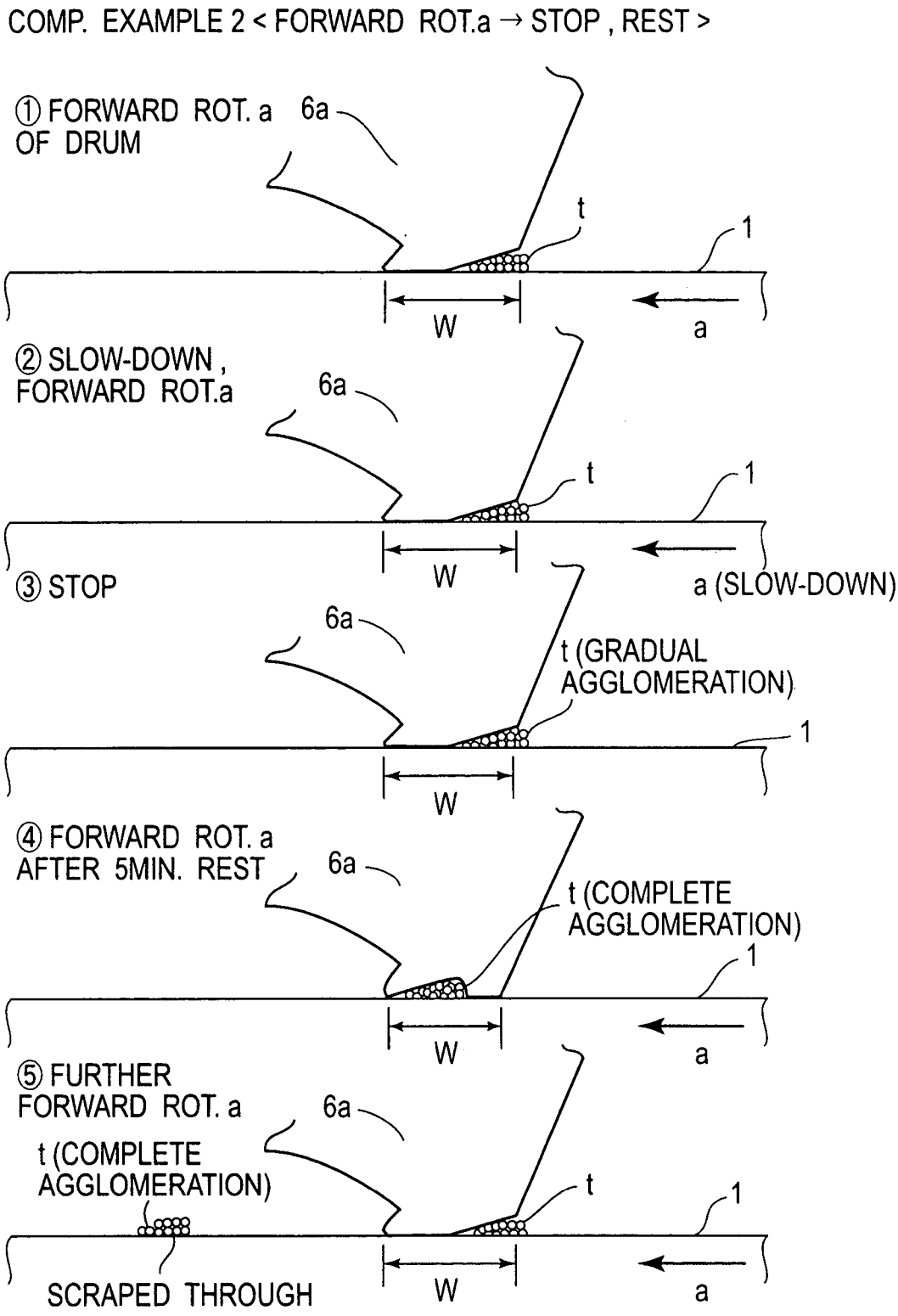
FIG. 7, consisting of parts (1) through (5), is a schematic sectional view of the contact area, and its adjacencies, between the cleaning edge of the cleaning blade and the peripheral surface of the image bearing member, in the second comparative example, showing the changes in the state of the cleaning edge, which is caused by the image bearing member rotation control carried out immediately after the completion of a given image forming job.

Rotation In Normal Direction a—Rotation in Normal Direction a at Reduced Velocity—Stop FIG. 7 is a schematic sectional view of the contact area W between the cleaning blade 6*a* and photosensitive drum 1, showing what occurred to the cleaning edge of the blade 6*a* and the lump of residual developer and/or external additive t when the peripheral velocity at which the photosensitive drum 1 was rotated in the normal direction a was reduced to ¼ the normal velocity before the rotation of the photosensitive drum 1 was stopped.

FIG. 7(1) shows the state of the contact area W during the rotation the photosensitive drum 1 in the normal direction a. In this state, the cleaning edge of the cleaning blade 6*a* remained deformed. This deformation of the cleaning edge occurred because the cleaning blade 6*a* was placed in contact with the peripheral surface of the photosensitive drum 1 so that the cleaning edge of the cleaning blade 6*a* counters the movement of the peripheral surface of the photosensitive drum 1 in the normal direction a, and therefore, the cleaning edge was dragged into the contact area W by the peripheral surface of the photosensitive drum 1 as the photosensitive drum 1 was rotated in the normal direction a. Therefore, as the residual developer and/or the external additive t was scraped away (removed) from the peripheral surface of the photosensitive drum 1, the removed residual developer and/or external additive t was likely to enter and/or remain in the gap between the deformed cleaning edge and the peripheral surface of the photosensitive drum 1; a certain portion of the residues remained there.

FIG. 7(2) shows what occurred in the contact area W and its adjacencies as the peripheral velocity at which the photosensitive drum 1 was rotated in the normal direction a was reduced to ¼, that is, 25 mm/sec. By the time the peripheral velocity of the photosensitive drum 1 was reduced, the actual image forming process had been completed. Therefore, it was unnecessary to remove an additional amount of waste toner (there is virtually no waste toner to be removed, on the peripheral surface of the photosensitive drum 1), and also, the inertia of the residual developer and/or external additive t, which acts in the direction to push the lump of developer and/or external additive t into the gap between the deformed cleaning edge of the blade 6 and the peripheral surface of the photosensitive drum 1, was reduced to virtually zero by the reduction of the peripheral velocity of the photosensitive drum 1. However, a certain amount of the developer and/or external additive t had already entered the gap between the deformed edge of the blade 6*a* and the peripheral surface of the photosensitive drum 1 as shown in FIG. 7(1).

FIG. 7(3) shows the state of the contact area W after the rotation of the photosensitive drum 1 at the reduced peripheral velocity in the normal direction a was stopped. In this state, the photosensitive drum 1 is not rotating. While the photosensitive drum 1 is not rotated, the developer and/or external additive t having collected between the blade 6*a* and photosensitive drum 1 is compressed by the deformed cleaning edge of the cleaning blade 6*a*, being thereby gradually agglutinated.

FIG. 7(4) shows the state of the contact area W immediately after the second printing operation B was started (photosensitive drum 1 began to be rotated in normal direction a) after the photosensitive drum 1 was not rotated for five minutes. In this state, the developer and/or external additive t had completely agglutinated and adhered to the photosensitive drum 1 while the photosensitive drum 1 was not rotated, and therefore, the developer and/or external additive t are capable of moving past the cleaning edge of the blade 6*a*.

FIG. 7(5) shows the state of the contact area W immediate after the developer and/or external additive t having agglutinated and adhered to the photosensitive drum 1 has moved past the blade 6*a*. This lump of developer and/or external additive t having agglutinated and adhered to the photosensitive drum 1 comes back to the cleaning blade 6*a* as the photosensitive drum 1 is rotated once. Then, as the photosensitive drum 1 is rotated further, the lump of developer and/or external additive t moves past the cleaning blade 6*a*. The portion of the peripheral surface of the photosensitive drum 1, to which the agglutinated developer and/or external additive t had adhered, is different in coefficient of friction from the rest of the peripheral surface of the photosensitive drum 1. Therefore, while this portion is moving through the contact area W, the load borne by the system for driving the photosensitive drum 1 is different from that while the rest is moved through the contact area W. Therefore, the portions of the latent image corresponding to this portion of the peripheral surface of the photosensitive drum 1 becomes blurred, resulting in the formation of a defective image, defective in that it suffers from parallel blurry strips.

It became evident from the testing of this second example of comparison that even if the rotation of the photosensitive drum 1 in the normal direction a is stopped after the peripheral velocity of the photosensitive drum 1 is reduced from the normal velocity, a certain amount of the developer and/or external additive t becomes stuck between the blade 6*a* and the peripheral surface of the photosensitive drum 1, and remains therein. Therefore, if this lump of residual developer and/or external additive t is left unattended, it moves past the cleaning blade 6*a* as the rotation of the photosensitive drum 1 in the normal direction a is restarted.

3) COMPARATIVE EXAMPLE 3

Rotation in Normal Direction a—Rotation in Reverse Direction b—Stop

Figure 8:
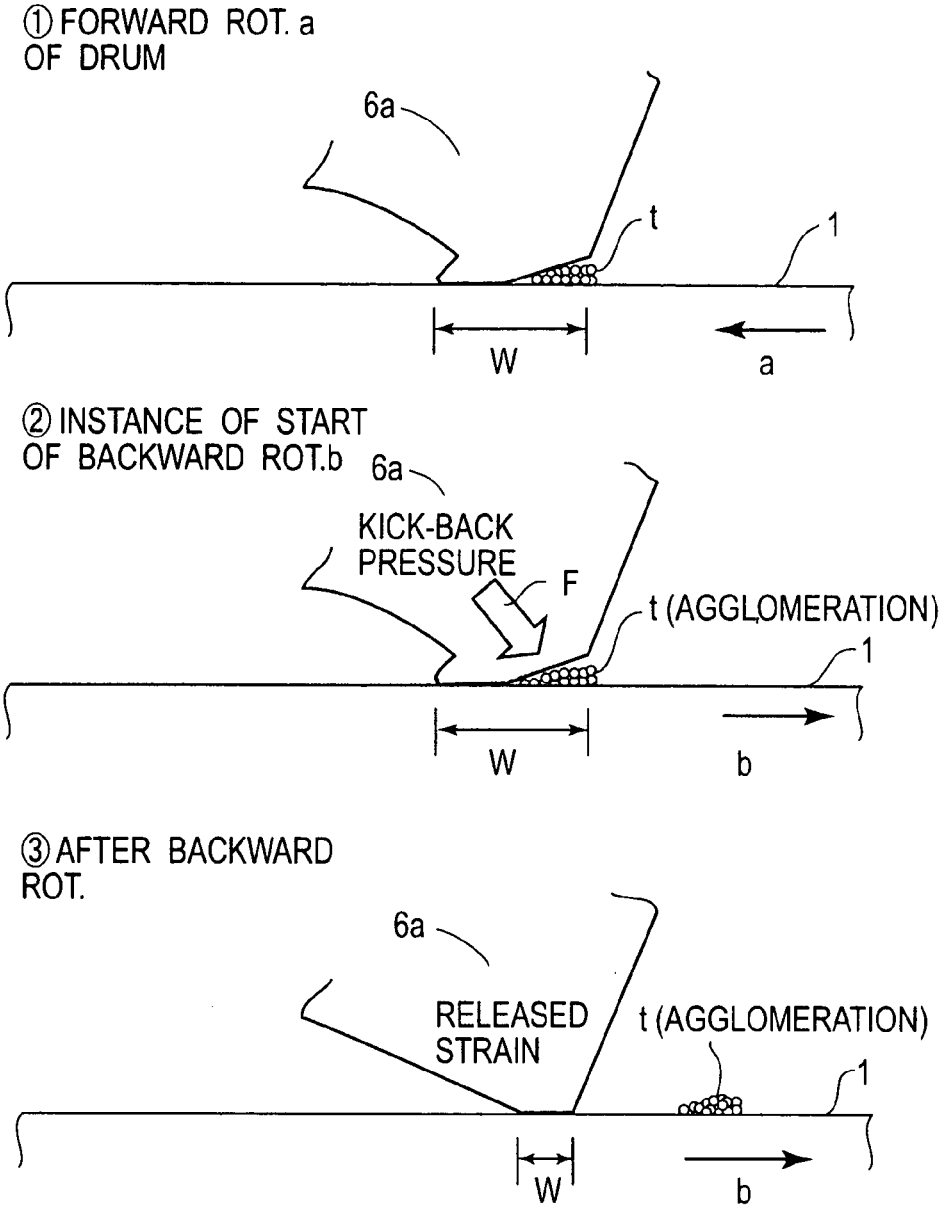
FIG. 8, consisting of parts (1) through 3, is a schematic sectional view of the contact area, and its adjacencies, between the cleaning edge of the cleaning blade and the peripheral surface of the image bearing member, in the third comparative example, showing the changes in the state of the cleaning edge, which is caused by the image bearing member rotation control carried out immediately after the completion of a given image forming job.

FIG. 8 is a schematic sectional view of the contact area W between the cleaning blade 6*a* and photosensitive drum 1, showing what occurred in the contact area W when the photosensitive drum 1 was briefly rotated in the reverse direction b after the rotation of the photosensitive drum 1 in the normal direction a was stopped. This example was described before as the control method in accordance with the prior art (Patent Document 1). However, it will be described in more detail here.

FIG. 8(1) shows the state of the contact area W during the rotation the photosensitive drum 1 in the normal direction a. In this case, the cleaning edge of the cleaning blade 6*a* remained deformed. This deformation of the cleaning edge occurred because the cleaning blade 6*a* was placed in contact with the peripheral surface of the photosensitive drum 1 so that the cleaning edge of the cleaning blade 6*a* counters the movement of the peripheral surface of the photosensitive drum 1 in the normal direction a, and therefore, the cleaning edge was dragged into the contact area W by the peripheral surface of the photosensitive drum 1 as the photosensitive drum 1 was rotated in the normal direction a. Therefore, as the residual developer and/or the external additive t was scraped away (removed) from the peripheral surface of the photosensitive drum 1, the removed residual developer and/or external additive t was likely to enter and/or remain in the gap between the deformed cleaning edge and the peripheral surface of the photosensitive drum 1; a certain portion of the residue remained there.

FIG. 8(2) shows the state of the contact area W immediately after the rotation of the photosensitive drum 1 in the reverse direction b was started. In this case, the residual developer and/or external additive t having collected between the blade 6*a* and the peripheral surface of the photosensitive drum 1 had already been made to agglutinate and adhere to the photosensitive drum 1 by the pressure generated by the resiliency of the deformed blade 6*a*.

FIG. 8(3) shows the state of the contact area W immediately after the completion of the rotation of the photosensitive drum 1 in the reverse direction b. In this case, the residual developer and/or external additive t having agglutinated and adhered to the peripheral surface of the photosensitive drum 1 remained firmly adhered to the peripheral surface of the photosensitive drum 1 although it had been moved upstream, in terms of the normal rotational direction a of the photosensitive drum 1, being therefor placed a short distance away from the contact area W. As the next rotation of the photosensitive drum 1 in the normal direction a is started for image formation, this body of the residual developer and/external additive t having firmly adhered to the peripheral surface of the photosensitive drum 1 moved past the contact area W, altering temporarily the load borne by the driving system for rotating the photosensitive drum 1, as it moved past the contact area W. As a result, images suffering from parallel blurry strips were outputted. The location of each blurry strip relative to the transfer medium corresponded to the location of the lump of the residual developer and/or external additive t having agglutinated and firmly adhered to the peripheral surface of the photosensitive drum 1 relative to the circumference of the photosensitive drum 1; there was only one blurry strip per rotational cycle of the photosensitive drum 1. In this case, as the photosensitive drum 1 is rotated in the reverse direction b, the blade 6*a* is allowed to recover from the deformation, and therefore, does not generates compressive force large enough to agglutinate the residual developer and/or external additive t. Therefore, the rotation of the photosensitive drum 1 in the reverse direction b does not affect the level of conspicuousness at which the parallel blurry strips are formed.

It became evident from the testing of this third comparative example that as the photosensitive drum 1 is rotated in the reverse direction b before the rotation of the photosensitive drum 1 for image formation is stopped, the lump of the residual developer and/or external additive t having collected in the gap between the deformed cleaning edge of the blade 6*a* and the peripheral surface of the photosensitive drum 1 was instantly compressed, being thereby agglutinated and firmly adhered to the peripheral surface of the photosensitive drum 1, by the force (FIG. 8(2)) generated by the resiliency of the cleaning edge of the blade 6*a* the moment the cleaning edge kicked as it snapped out of the deformation; as a result, the lump of the residual developer and/or external additive t having agglutinated and firmly adhered to the peripheral surface of the photosensitive drum 1 moved past the contact area W as the photosensitive drum 1 was rotated again in the normal direction a for image formation. It also became evident that because after the rotation of the photosensitive drum 1 in the reverse direction b, the cleaning edge of the cleaning blade 6*a* was in contact with the peripheral surface of the photosensitive drum 1 without being deformed, the agglutination of the residual developer and/or external additive t did not occur (there was no developer and/or external additive t sandwiched between blade and photosensitive drum).

4) Summary of Tests of Comparative Examples 1–3

[a] Case in which the Photosensitive Drum is Stopped While Being Rotated in the Normal Direction a Blade shape does not change, and therefore, the residual developer and/or external additive t collected between the blade 6*a* and the peripheral surface of the photosensitive drum 1 does not agglutinate and firmly adhere to the peripheral surface of the photosensitive drum 1, as long as the length of time the photosensitive drum 1 is not rotated is no more than 1 minute.

If the collected residual developer and/or external additive t is left unattended no less than 1 minute, it is agglutinated by the continuous pressure applied thereto by the resiliency of the deformed blade 6*a*.

[b] Case in which the Peripheral Velocity of the Photosensitive Drum 1 is Reduced to a Predetermined Value Before the Photosensitive Drum 1 Being Rotated in the Normal Direction a is Completely Stopped The developer and/or external additive t having collected at the cleaning edge of the blade 6*a* cannot be removed.

[c] Case in which the Photosensitive Drum 1 is Briefly Rotated in Reverse Direction b after the Rotation of the Photosensitive Drum 1 for Image Formation is Stopped The residual developer and/or external additive t having collected between the deformed cleaning edge of the blade 6*a* and the peripheral surface of the photosensitive drum 1 is instantly agglutinated by the force F generated by the resiliency of the deformed cleaning edge of the blade 6*a* as the cleaning edge kicks the residues when it snaps out of the deformation.

Since the blade does not remain deformed, the residual developer and/or external additive t is not agglutinated by the blade while it is left unattended; there is no residual developer and/or external additive t between the cleaning edge of the blade 6*a* and the peripheral surface of the photosensitive drum 1.

Therefore, it is evident that the agglutination of the residual developer and/or external additive t having collected between the deformed cleaning edge of the cleaning blade 6*a* and the peripheral surface of the photosensitive drum 1, which is expected to occur while it is left unattended (while the photosensitive drum 1 is not rotated), can be prevented by reducing as much as possible the amount by which the residual developer and/or external additive t remains in the gap between the deformed cleaning edge and the photosensitive drum, by rotating the photosensitive drum 1 in the reverse direction b after the rotation of the photosensitive drum 1 in the normal direction a for image formation is stopped, in Case [c].

As will now be described in further detail, if the amount of the residual developer and/or external additive t remaining between the blade 6*a* and photosensitive drum 1, as shown in FIG. 8(1), is reduced as much as possible by rotating the photosensitive drum 1 in the reverse direction b, as shown in FIG. 8(2), within no more than one minute after the stopping of the rotation of the photosensitive drum 1 in the normal direction a for image formation, the formation of the parallel blurry strips does not occur, even if the photosensitive member 1 is not rotated for a substantial length of time. However, simply reducing the peripheral velocity of the photosensitive drum 1 before stopping the rotation of the photosensitive drum 1 in the normal direction a for image formation does not remove the lump of residual developer and/or external additive t having stuck between the blade and photosensitive drum.

Next, the embodiments of the sequence for controlling the rotation of the photosensitive drum 1, in accordance with the present invention, will be described.

Figure 9:
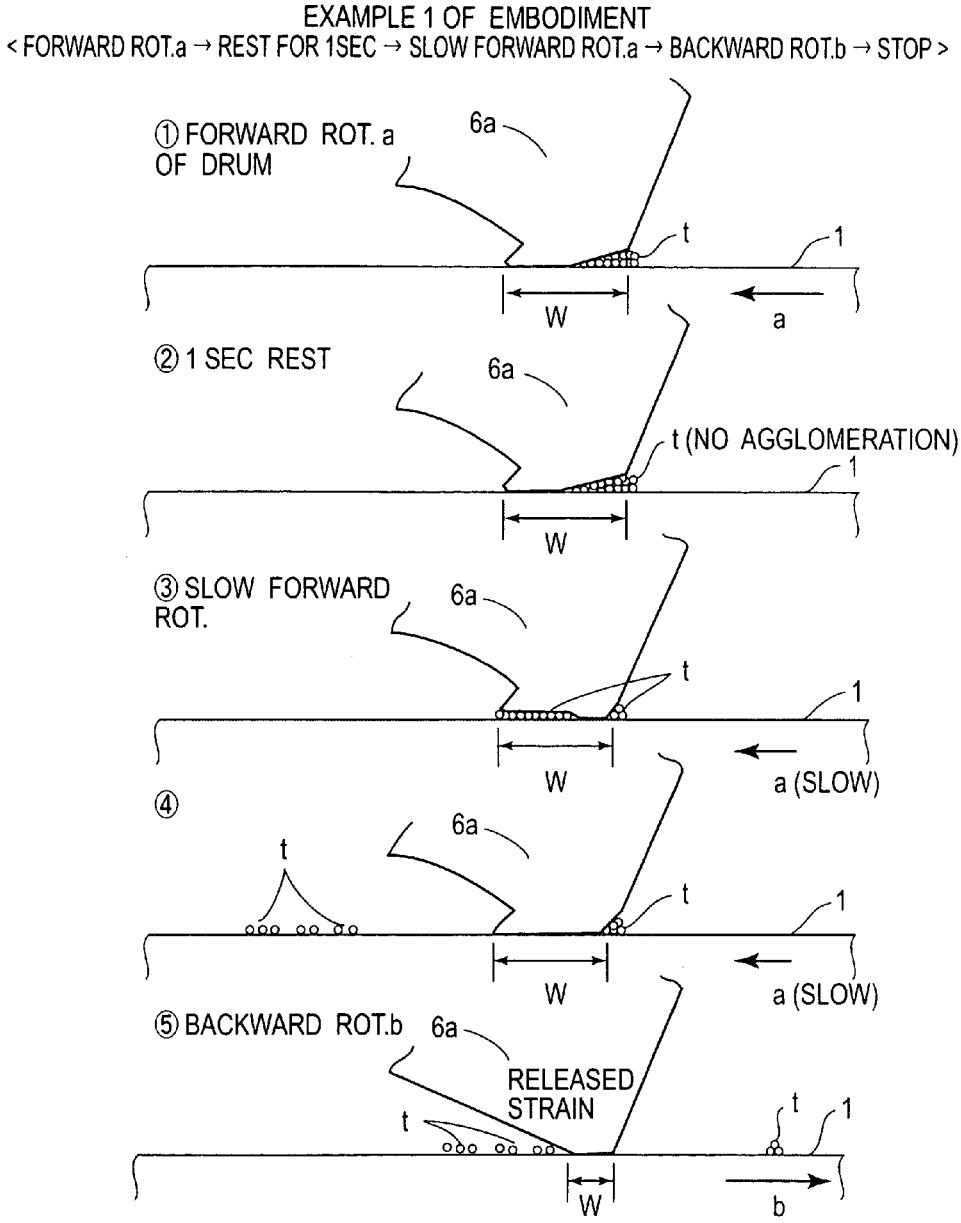
FIG. 9, consisting of parts (1) through (5), is a schematic sectional view of the contact area, and its adjacencies, between the cleaning edge of the cleaning blade and the peripheral surface of the image bearing member, in the first or second embodiment of the present invention, showing the changes in the state of the cleaning edge, which is caused by the image bearing member rotation control carried out immediately after the completion of a given image forming job.

5) Embodiment 1-1 (Rotation in Normal Direction a—Stop One Second—Rotation in Normal Direction a at Reduced Velocity—Rotation in Reverse Direction b—Stop FIG. 9 shows what occurs to the residual developer and/or external additive t and the cleaning edge of the blade 6*a* when the photosensitive drum being rotated in the normal direction for image formation is stopped for one second; is rotated in the normal direction at ¼ the normal peripheral velocity for image formation; and then, is rotated in reverse.

FIG. 9(1) shows the state of the contact area between the cleaning edge of the cleaning blade 6*a* and the peripheral surface of the photosensitive drum 1 being rotated in the normal direction a. In this state, the cleaning edge of the cleaning blade 6*a* is deformed for the following reason. That is, the cleaning blade 6*a* is placed in contact with the peripheral surface of the photosensitive drum 1 so that the cleaning edge of the cleaning 6*a* contradicts the movement of the peripheral surface of the photosensitive drum 1 in the normal direction a. Therefore, as the photosensitive drum 1 is rotated in the normal direction a, the friction between the cleaning edge and the photosensitive drum 1 drags the cleaning edge downstream in terms of the normal rotational direction a of the photosensitive drum 1. Further, the lump of the developer and/or external additive t having been scraped off the peripheral surface of the photosensitive drum 1 and agglomerated on the immediately upstream side of the aforementioned contact area is dragged by the peripheral surface of the photosensitive drum 1 in the normal rotational direction a of the photosensitive drum 1, being therefore likely to enter the gap between the deformed cleaning edge of the cleaning blade 6*a* and the peripheral surface of the photosensitive drum 1.

FIG. 9(2) shows the state of the contact area between the cleaning edge of the cleaning blade 6*a* and the peripheral surface of the photosensitive drum 1 while the photosensitive drum 1 was not rotated for no more than one minute immediately after the rotation of the photosensitive drum 1 in the normal direction a was stopped. As described before, as long as the length of time the photosensitive drum 1 is not rotated is no more than one minute, the developer and/or external additive t does not agglutinate. In this embodiment, the photosensitive drum 1 is stopped for one second.

FIG. 9(3) shows the state of the contact area between the cleaning edge of the blade 6*a* and the photosensitive drum 1 immediately after the photosensitive drum 1 is rotated in the normal direction a at ¼ the normal peripheral velocity, that is, 25 mm/sec, for 40 msec after being reduced in peripheral velocity to ¼ the normal velocity from the normal velocity. In other words, before the rotation of the photosensitive drum 1 in the normal direction a is stopped, the peripheral velocity of the peripheral surface of the photosensitive drum 1 is ¼ the peripheral velocity at which the photosensitive drum 1 is rotated during the formation of an image. In this state, the printing operation has already ended. Therefore, it is unnecessary to remove the waste (residual) toner, and also, the inertia of the developer and/or external additive t, which acts in the direction to force the developer and/or external additive t to enter the gap between the cleaning edge of the blade 6*a* and the photosensitive drum 1, is virtually gone because of the reduction in the peripheral velocity of the photosensitive drum 1. In addition, during the period immediately before the rotation of the photosensitive drum 1 was stopped, the photosensitive drum 1 was rotated at the reduced peripheral velocity, making it easier for the blade 6*a* to flawlessly contact the peripheral surface of the photosensitive drum 1. As a result, the blade 6*a* was placed virtually flawlessly in contact with the peripheral surface of the photosensitive drum 1, making it difficult for the developer and/or external additive t to enter the interface between the cleaning edge of the blade 6*a* and the peripheral surface of the photosensitive drum 1.

FIG. 9(4) shows the state of the contact area between the blade 6*a* and photosensitive drum 1, and its adjacencies, after the photosensitive drum 1 is rotated at ¼ the normal peripheral velocity for 40 msec. In this state, the developer and/or external additive t having had stuck in the gap between the blade 6*a* and photosensitive drum 1 has been moved out downward of the contact area by the movement of the peripheral surface of the photosensitive drum 1. The width of the contact area W (nip width), in terms of the rotational direction of the photosensitive drum 1, between the blade 6*a* and photosensitive drum 1 is roughly 500 μm, and the distance by which the peripheral surface of the photosensitive drum 1 of the image forming apparatus in this embodiment was moved was 25×60=1500 (μm), which was enough to move the residual developer and/or external additive t having had stuck in the gap between the blade 6*a* and photosensitive drum 1 out downward of the contact area W (nip). The nip width means the length, in terms of the rotational direction of the photosensitive drum 1, by which the blade 6*a* remains in contact with the peripheral surface of the photosensitive drum 1.

FIG. 9(5) shows the state of the contact area between the blade 6*a* and photosensitive drum 1 after the photosensitive drum 1 was rotated in the reverse direction b. The peripheral velocity of the reverse rotation was 100 mm/sec, which was the same as that of the normal rotation, and the duration of the reverse rotation was 400 msec. In this state, there was virtually no residual developer and/or external additive t stuck between the blade 6*a* and photosensitive drum 1. Therefore, the agglutination of the residual developer and/or external additive t did not occur even though the deformed cleaning edge of the blade 6*a* snapped back into the natural shape as the photosensitive drum 1 was rotated in the reverse direction b. The small lump of residual developer and/or external additive t which was next to the upstream edge of the contact area between the blade 6*a* and photosensitive drum 1, in terms of the normal rotational direction a of the photosensitive drum 1, and had not agglutinated, remained as it was on the peripheral surface of the photosensitive drum 1. Therefore, when the photosensitive drum 1 was rotated in the normal direction a for the next printing operation, this lump of the residual developer and/or external additive t did not move past the cleaning blade 6*a*. Therefore, no image suffering from the parallel blurry strips was formed. Moreover, after the reversal rotation of the photosensitive drum 1 allowed the cleaning edge of the blade 6*a* to recover from the deformation, the pressure which the cleaning edge of the blade 6*a* generated was not strong enough to cause the residual developer and/or external additive t to agglutinate. Therefore, as long as the blade 6*a* and photosensitive drum 1 was left in the state shown in FIG. 9(5), the following image forming operation did not yield any image suffering from the parallel blurry strips even after the image forming apparatus was left unattended for a substantial length of time.

6) Embodiment 1-2 (Rotation in Normal Direction a—Stop One Eecond—Rotation in Normal Direction a at Reduced Peripheral Velocity (before Pre-Rotation)—Rotation in Reverse Direction b—Stop The second embodiment utilizes the startup of the motor 11 for rotating the photosensitive drum 1 in the normal direction a at a reduced peripheral velocity after stopping the rotation of the photosensitive drum 1 in the normal direction a the normal velocity. More specifically, a motor which starts up slowly is employed as the motor 11, and the velocity at which the motor rotates during its startup period is used as the velocity at which the photosensitive drum 1 is rotated in the normal direction a after the aforementioned normal rotation of the photosensitive drum 1. The employment of this procedure can provide the same effect as that provided by the first embodiment in which the velocity of the motor 11 is kept low by the arbitrary control.

Figure 10:
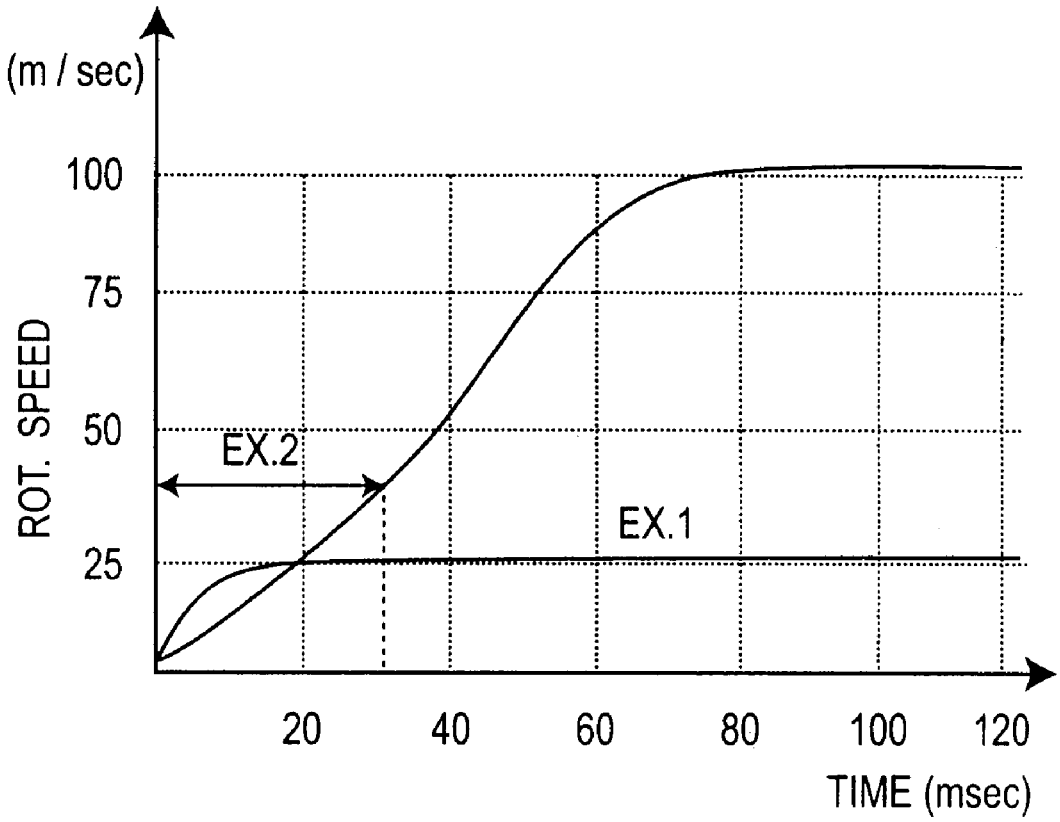
FIG. 10 is a graph showing the relationship between the elapsed time and the peripheral velocity of the image bearing member, during the startup period, in the second embodiment of the present invention.

FIG. 10 is a graph showing the relationship between the length of time power is supplied to the motor 11, and the peripheral velocity of the photosensitive drum 1. In the first embodiment, control is executed so that the peripheral velocity of the photosensitive drum 1 remains at ¼ the normal velocity, that is, 25 mm/sec, and a motor which starts up fast is employed as the motor 11. In comparison, in this embodiment, a motor which is slow in startup speed is employed, and the length of time power is supplied to the motor after the stopping of the photosensitive drum 1 at the completion of a given printing job is set to 30 msec. Therefore, the photosensitive drum 1 is rotated at an average peripheral velocity of 20 mm/sec.

In other words, in this embodiment, the photosensitive drum 1 which is being rotated in the normal direction a after the completion of a given print job, is stopped for one second, and then, is rotated at an average peripheral velocity lower than the normal peripheral velocity of the photosensitive drum 1, by utilizing the startup velocity of the motor 11 during the period in which the motor 11 accelerates from zero velocity to the predetermined rotational velocity. The other aspects of this embodiment, in terms of the control, etc., are the same as those of the first embodiment, and the changes in the state of the contact between the blade 6*a* and photosensitive drum 1 which occur in this embodiment are the same as those in the first embodiment (FIG. 9), and therefore, will not be described here.

Further, in order to prevent the intermediary transfer belt 30 from being contaminated by the residual developer and/or external additive t when the photosensitive drum 1 is rotated in the reverse direction b according to the second embodiment, the angle by which the photosensitive drum 1 is rotated in the reverse direction b is desired to be no more than the angle between the plane connecting the upstream edge of the contact area between the blade 6*a* and photosensitive drum 1 and the axial line of the photosensitive drum 1, and the plane connecting the downstream edge of the contact area between the primary transfer roller 5 (actually, intermediary transfer belt 30) and the axial line of the photosensitive drum 1. In other words, the distance by which the peripheral surface of the photosensitive drum 1 is moved by the rotation of the photosensitive drum 1 in the reverse direction b is desired to be no more than the distance between the aforementioned nip W and the contact area between the photosensitive drum 1 and intermediary transfer belt 30 (intermediary transfer roller 5).

Further, it is possible that as the photosensitive drum 1 is rotated in the reverse direction b, the developer overflows from the developing apparatus 4. Therefore, it is desired that while the photosensitive drum 1 is rotated in the reverse direction b, the developing apparatus 4 (developer bearing member) is kept separated from the photosensitive drum 1 by a separating means (unshown), or the rotation of the developing apparatus 4 (developer bearing member) is stopped.

The first and second embodiments were described with reference to the image forming apparatus having the intermediary transfer belt 30. However, the first and second embodiments methods are also effectively usable with an image forming apparatus having an intermediary transfer drum instead of an intermediary transfer belt, and also, with an image forming apparatus in which images are directly transferred from the photosensitive drums 1 onto a recording paper.

Further, the first and second embodiments were described with reference to the image forming apparatus which employs only a single motor for driving two or more photosensitive drums 1. However, the first and second embodiments are also effectively usable with an image forming apparatus which employs two or more motors for individually driving two or more photosensitive drums 1.

Moreover, the present invention also concerns the relationship between the intermediary transfer belt 30 as the second image bearing member and the cleaning apparatus 33 for cleaning the belt 30. In other words, using the present invention to control the rotation of the cleaning belt 30 of the cleaning apparatus 33 during the interval between two printing jobs brings forth the same effects as those obtained as the present invention is used to control the rotation of the photosensitive drum during the interval between two printing jobs.

Embodiment 2

In the first embodiment, in order to prevent the formation of an image suffering from the parallel blurry strips attributable to exposure blur, the agglutination of the residual developer and/or external additive t, which causes the exposure blur, is prevented by dispersing the lump of residual developer and/or external additive t having collected at the cleaning edge of the cleaning blade 6*a* by devising a method for controlling the rotation of the photosensitive drum 1 during the period in which the photosensitive drum 1 is brought to complete stop at the end of a given printing job. In comparison, in the second embodiment, the agglutination of the residual developer and/or external additive t, which is the cause of the exposure blur, is minimized by dispersing the residual developer and/or external additive t having collected at the cleaning edge of the cleaning blade 6*a* by devising a method for controlling the rotation of the photosensitive drum 1 during the period in which the photosensitive drum 1 is started up to the normal operational velocity.

(1) Example of Image Forming Apparatus

Figure 12:
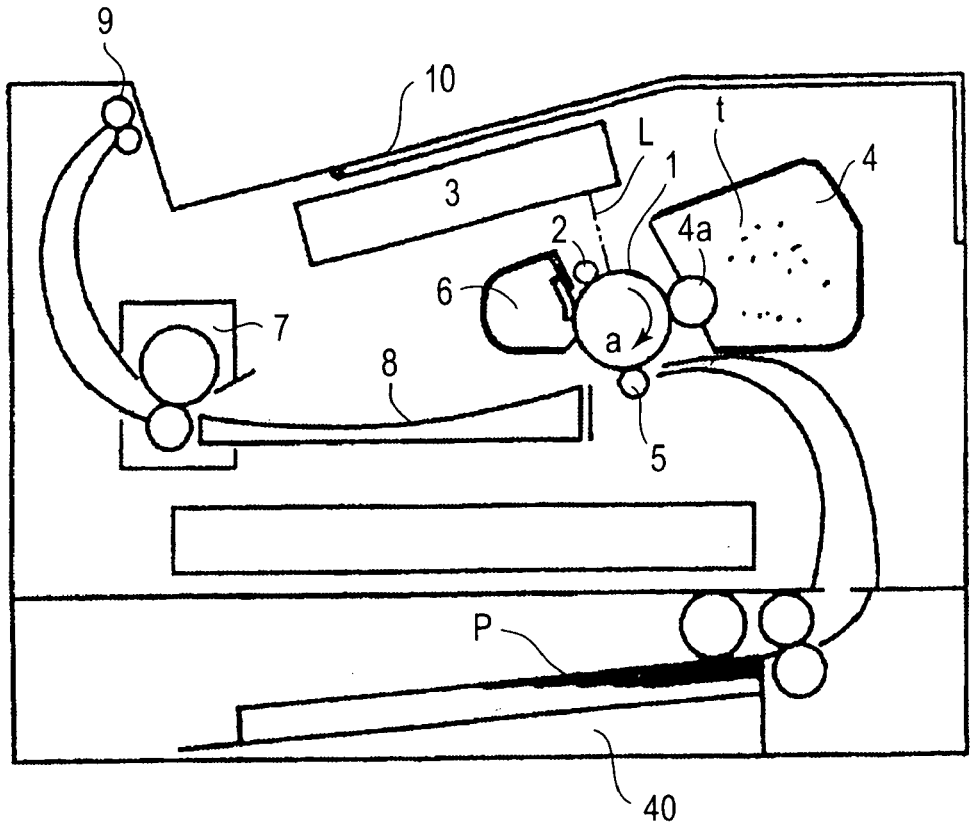
FIG. 12 is a schematic sectional view of the image forming apparatus in the second embodiment (as well as third embodiment) of the present invention, showing the general structure thereof.

FIG. 12 is a schematic sectional view of an example of an electrophotographic laser printer of a direct transfer type, in this embodiment, showing the general structure thereof. The image formation sequence of this printer is as follows. The photosensitive drum 1 as an image bearing member of the printer is rotationally driven at a predetermined peripheral velocity in the clockwise direction indicated by an arrow mark a in the drawing. As the photosensitive drum 1 is rotated, it is uniformly charged to predetermined polarity and potential level by the charge roller 2 (cleaning roller) to which predetermined charge bias is being applied from an unshown power source circuit. The uniformly-charged peripheral surface of the photosensitive drum 1 is exposed to an exposure light, that is, a beam of light L emitted from the laser scanner 3 while being modulated by video signals; it is scanned by the exposure light L. As a result, an electrostatic latent image reflecting the image formation data is formed on the peripheral surface of the photosensitive drum 1. This electrostatic latent image is developed, normally or in reverse, by the developing apparatus 4 into a visible image, or an image formed of toner (developer) (which hereinafter will be referred to as toner image or developer image). Designated by a referential letter t is the toner, as developer, stored in the developing apparatus 4, and designated by a referential number 4*a* is a rotatable development sleeve. The electrostatic latent image on the peripheral surface of the photosensitive drum 1 is developed into a visible image (toner image) with the toner t borne on the peripheral surface of the development sleeve 4*a* which is kept different in potential level from the photosensitive drum 1 by an unshown power source circuit. In synchronism with the progression of the formation of the toner image, a transfer medium P (recording medium such as recording paper) is delivered to the contact area between the photosensitive drum 1 and transfer roller 5 by the sheet feeding unit 40. Then, as the transfer medium P is conveyed through the contact area, the toner image on the peripheral surface of the photosensitive drum 1 is transferred onto the transfer medium P by the transfer roller 5, as a transferring means, which is kept different in potential level from the photosensitive drum 1 by an unshown power source circuit. Then, the transfer medium P is guided by the conveyance guide 8 to the fixation unit 7. In the fixation unit 7, heat and pressure is applied to the combination of the transfer medium P and the unfixed toner image thereon, fixing the toner image to the transfer medium P. Thereafter, the transfer medium P is discharged by the pair of discharge rollers 9 into the delivery tray 10. Meanwhile, the portion of the peripheral surface of the photosensitive drum 1, from which the transfer medium P was separated, is cleared of the transfer residual toner by the cleaning apparatus 6 of a blade type, and is used again for image formation.

Figure 13:
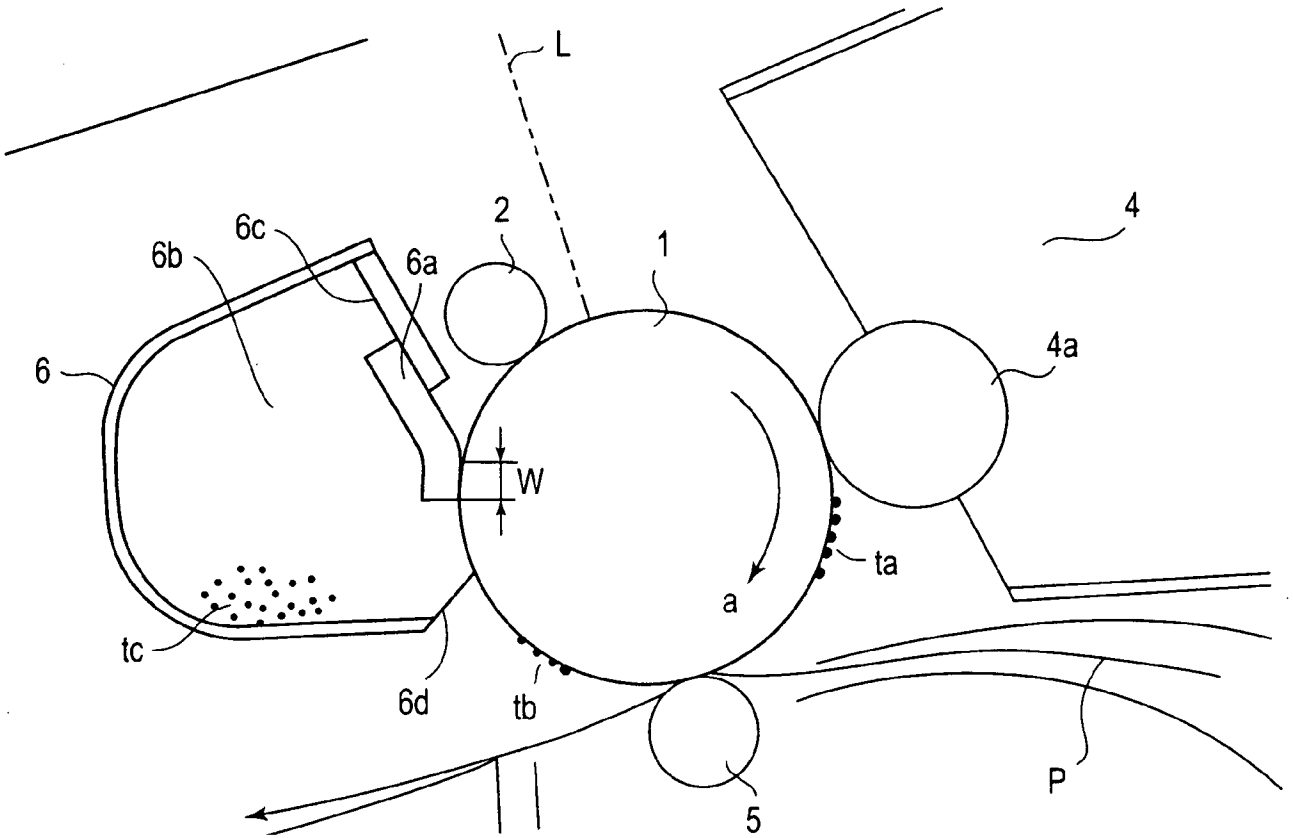
FIG. 13 is an enlarged schematic sectional view of the portion of the image forming apparatus, shown in FIG. 12, related to the gist of the present invention.

Next, the portion of the image forming apparatus, which is in the adjacencies of the photosensitive drum 1, will be described regarding its structure. Also, the process for cleaning the peripheral surface of the photosensitive drum 1, will be described. FIG. 13 is an enlarged sectional view of the photosensitive drum 1 and its adjacencies.

Designated by a referential symbol ta is the developer image formed on the peripheral surface of the photosensitive drum 1 by the development sleeve 4*a* with the use of the developer t. This developer image ta is transferred onto the transfer medium P. However, a small portion of the developer in the developer image ta fails to be transferred onto the transfer medium P, and remains on the peripheral surface of the photosensitive drum 1; a referential symbol tb designates the developer left on the peripheral surface of the photosensitive drum 1 after the transfer of the developer image ta. The cleaning blade 6*a* (cleaner blade) of the cleaning apparatus 6 of a blade type is provided for scraping the peripheral surface of the photosensitive drum 1 to make the developer tb, or the developer having failed to be transferred from the peripheral surface of the photosensitive drum 1 onto the transfer medium P, fall down from the peripheral surface of the photosensitive drum 1. The sealing sheet 6*d* is for preventing the developer tc, that is, the developer scraped of the photosensitive drum 1, from blowing out of the cleaning apparatus 6 as the developer tb is scraped off the peripheral surface of the photosensitive drum 1. In order for the cleaning blade 6*a* to effectively clean the peripheral surface of the photosensitive drum 1, the blade 6*a* must be placed in contact with the peripheral surface of the photosensitive drum 1 so that the cleaning edge of the blade 6*a* counters the movement of the peripheral surface of the photosensitive drum 1 in the normal direction a. Thus, in order to prevent the cleaning edge of the blade 6*a* from being bent downstream, the blade 6*a* is placed in contact with the peripheral surface of the photosensitive drum 1 so that a contact nip, the dimension of the which in terms of the rotational direction of the photosensitive drum 1 is W, is formed between the blade 6*a* and photosensitive drum 1.

The printing sequence of the image forming apparatus in this embodiment is the same as that (FIG. 3) in the first embodiment.

(2) Embodiment 2-1 (Brief Rotation X—Stop (No More Than One Second)—Start Up (for Image Formation)

During the standby period, that is, the period between when an image formation job A ends and when an image forming job B, or the next image forming process, begins, the photosensitive drum 1 is kept still (not rotated). During this period, the cleaning blade 6*a* is kept in contact with the peripheral surface of the photosensitive drum 1, preserving the contact area with the width of W. Therefore, the residual developer and/or external additive t having been trapped in the gap between the blade 6*a* and photosensitive drum 1 is agglutinated and adhered to the peripheral surface of the photosensitive drum 1. Consequently, the portion of the peripheral surface of the photosensitive drum 1, which is in the contact area with the width of W during the standby period, becomes different in coefficient of friction from the rest of the peripheral surface of the photosensitive drum 1.

The image forming apparatus being kept on standby is started up by the command issued by a computer, as a printer controlling means (unshown), to start the image formation job B. In this embodiment, the second image formation job B is carried out following the following sequence so that the portion of the peripheral surface of the photosensitive drum 1, which is different in coefficient of friction from the rest of the peripheral surface of the photosensitive drum 1, is widened to reduce the difference in coefficient of friction between the former and the latter.

Figure 14:
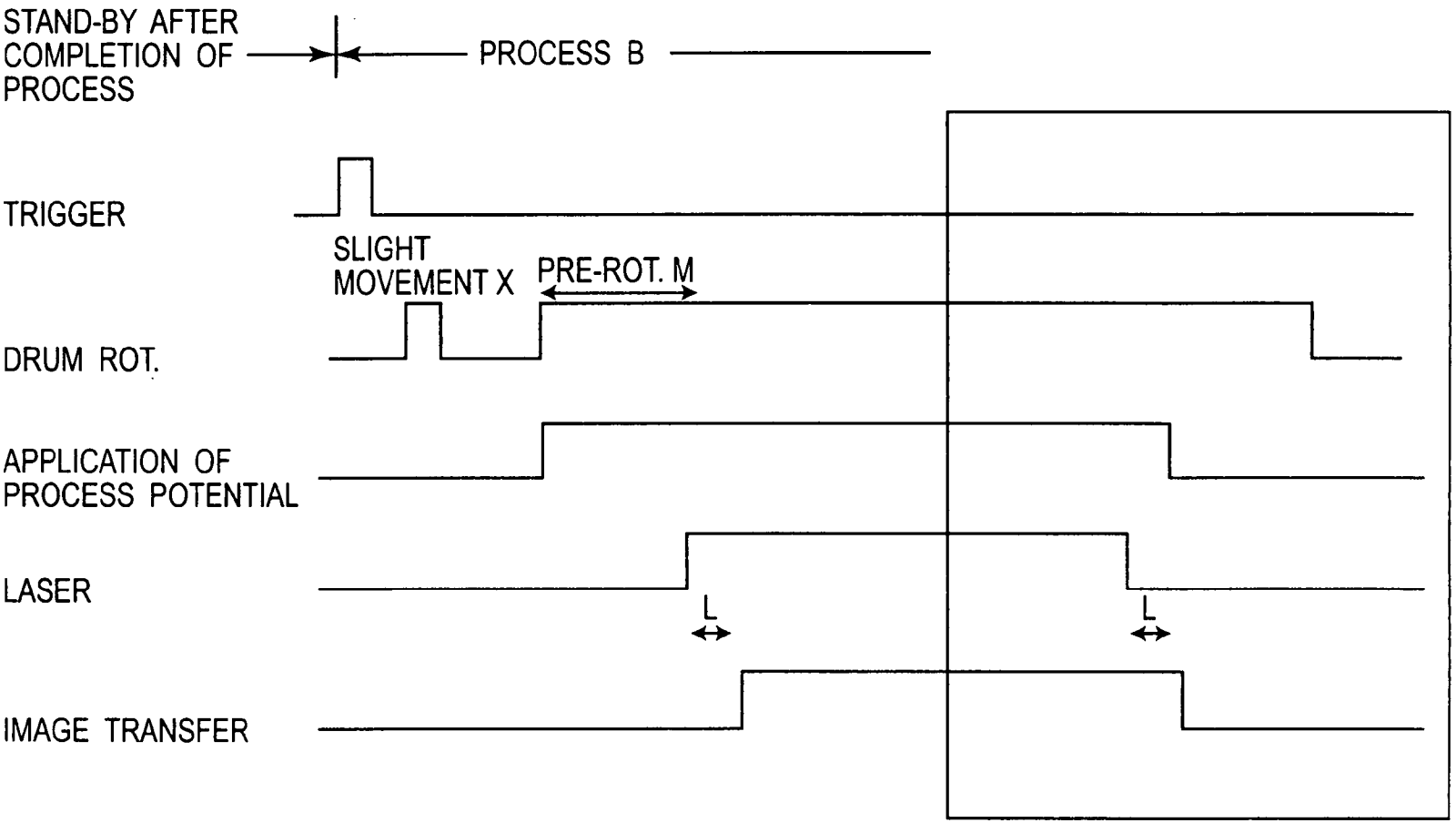
FIG. 14 is a diagram showing the sequences for controlling the image forming apparatus in accordance with the present invention.

More specifically, referring to FIG. 14, the image formation trigger is an internal signal which is generated after the print command is issued from a computer, and image formation data are transferred. It signals that the image forming apparatus has become ready for printing.

As soon as the image forming apparatus becomes ready for image formation, the photosensitive drum 1 is rotated for a very brief length X of time. In consideration of the acceleration curve of the motor for driving the photosensitive drum 1, responsiveness of the driving force transmission mechanism located between the motor and photosensitive drum 1, this very brief length X of time is made to be just enough for the peripheral surface of the photosensitive drum 1 to be moved a distance equal to the width W of the nip. After the photosensitive drum 1 is rotated for the brief length X of time, it is temporarily stopped in order to utilize static friction to loosen and disperse the lumps of the agglutinated residual developer and/or external additive at the beginning of the next rotation of the photosensitive drum 1 in the normal direction a. This utilization of static friction disperses the lumps of the residual developer and/or external additive across the area roughly twice the size of the contact area with the wide W. It should be noted here that if the photosensitive drum 1 is kept still for no less than one minute, it is possible for the residual developer and/or external additive to be agglutinated in the contact area while the photosensitive drum 1 is kept still (after the brief rotation). Therefore, it is desired that the photosensitive drum 1 is kept still no more than one minute after the brief rotation.

After the photosensitive drum 1 is briefly driven, it is temporarily kept still, and then, is rotated again (pre-rotation step M). In this pre-rotation step M, the beam of laser light is yet to be projected onto the peripheral surface of the photosensitive drum 1, and the transfer medium P is not between the photosensitive drum 1 and transfer roller 5. In the pre-rotation step M, the photosensitive drum 1 is rotated no less than one full turn. Therefore, the portion (width of which has been increased to roughly twice the contact area W by brief drive) of the peripheral surface of the photosensitive drum 1, which is different in coefficient of friction from the rest of the peripheral surface of the photosensitive drum 1, is moved past the cleaning blade 6*a* twice. Immediately after the completion of the pre-rotation step M, the projection of the beam of laser light begins for image formation; the peripheral surface of the photosensitive drum 1 is exposed to the beam of laser light. Then, the transfer medium P is conveyed to the transfer nip between the photosensitive drum 1 and transfer roller 5 in synchronism with the arrival of the portion of the peripheral surface of the photosensitive drum 1, across which an image has been formed, at the transfer nip.

The operational sequence which is carried out in FIG. 13 was described only as a part of the overall sequence, and will not be described in detail.

Figure 15:
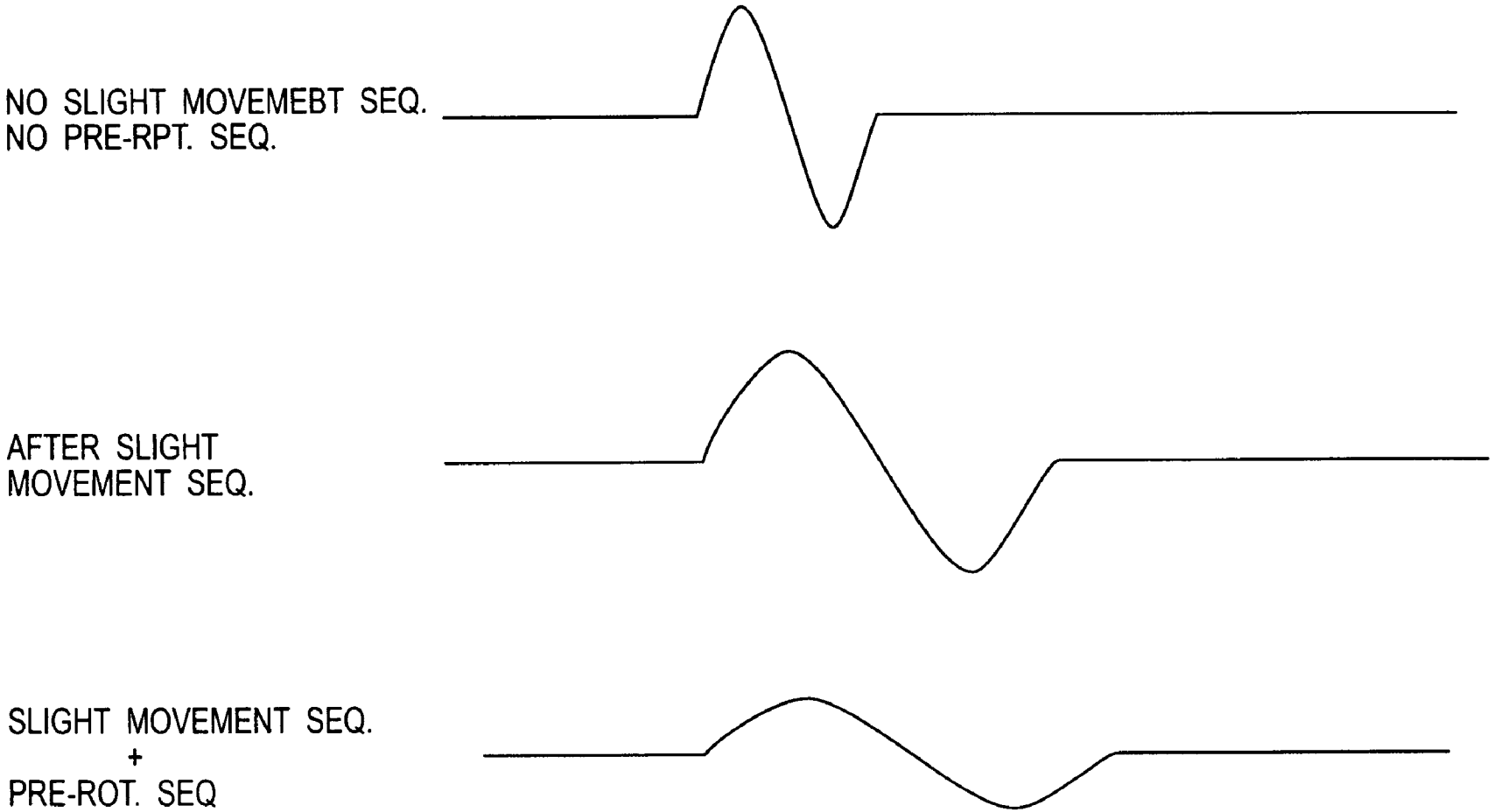
FIG. 15 is a drawing showing the fluctuation in the peripheral velocity of the image bearing member.

The changes in coefficient of friction, which can be expected as one of the results of the execution of the above described operational sequence, are shown in FIG. 15, which is a graph conceptually depicting the changes, in the peripheral velocity of the photosensitive drum 1, which occur as the portion of the peripheral surface of the photosensitive drum 1, which is different in coefficient of friction from the rest of the peripheral surface of the photosensitive drum 1, is moved past the cleaning blade 6*a* for the second time after the brief driving the photosensitive drum 1. The addition of the step in which the photosensitive 1 is driven for the very short length X of time does not reduce the amplitude of the changes, but, widens the area of the peripheral surface of the photosensitive drum 1 across which the coefficient of friction is different from the rest of the peripheral surface of the photosensitive drum 1. Therefore, the image defect, or the aforementioned parallel blurry strips, which is attributable to the changes in the peripheral velocity of the photosensitive drum 1, is less conspicuous; in other words, images formed using the this control sequence will be superior in quality.

Further, the addition of the pre-rotation sequence reduces the changes in the coefficient of friction itself, increasing the length of time the peripheral velocity of the photosensitive drum 1 is different from the normal peripheral velocity of the photosensitive drum for image formation. Further, the area of the peripheral surface of the photosensitive drum 1 different in coefficient of friction from the rest of the peripheral surface of the photosensitive drum 1 becomes wider, which in turn further reduces the level of conspicuousness of the image defects, or the parallel blurry strips.

Further, applying at least one of the process voltages (charge bias, development bias, transfer bias, etc.) during the pre-rotation period is effective to disperse the residues having adhered to the peripheral surface of the photosensitive drum 1, being therefore effective to make more gradual the changes in the coefficient of friction of the peripheral surface of the photosensitive drum 1. For example, if charge or transfer bias is applied, the residues adhering to the peripheral surface of the photosensitive drum 1 are transferred onto the charge roller or transfer roller, respectively, or electric charge is removed from the residue, making it easier for the residues to be removed from the photosensitive drum 1. Further, if development bias is applied while the development roller is in contact with the photosensitive drum 1, the residue adhering to the peripheral surface of the photosensitive drum 1 are coated with toner, becoming therefore easily removable from the photosensitive drum 1.

Embodiment 3

In third embodiment, in order to deal with the occurrence of the exposure blur, not only is the rotation of the photosensitive drum is controlled, in terms of peripheral velocity and/or direction, at the end of a given printing job, but also, at the beginning of the following printing job.

Figure 16:
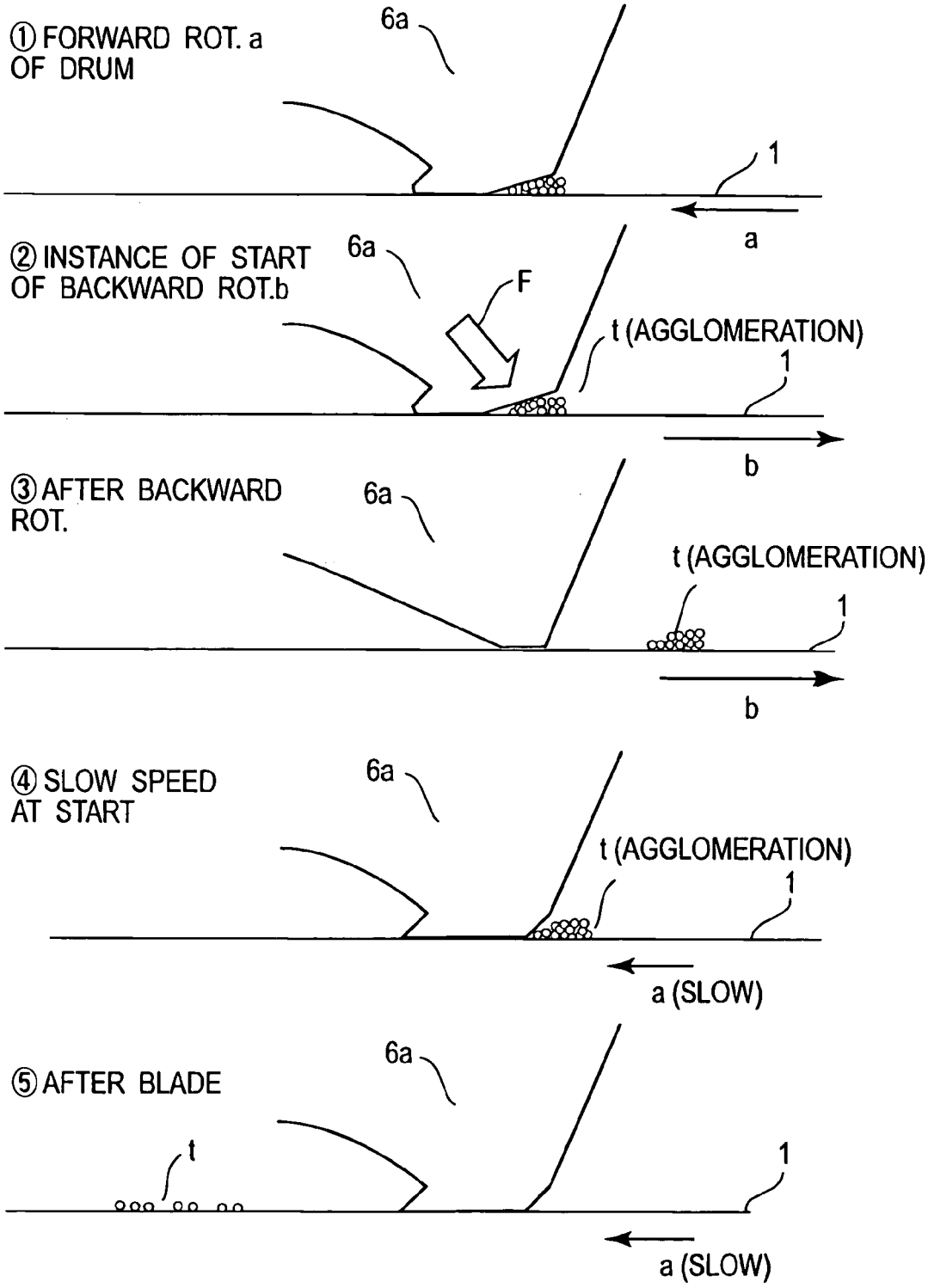
FIG. 16 consisting of parts (1) through (5) is a schematic sectional view of the contact area, and its adjacencies, between the cleaning edge of the cleaning blade and the peripheral surface of the image bearing member, in the fourth embodiment, showing the changes in the state of the cleaning edge, which is caused by the image bearing member rotation control carried out immediately after the completion of a given image forming job.

(1) Embodiment 3-1 (Rotation in Normal Direction a—Rotation In Reverse Direction b—Stop (Left Unattended)—Rotation in Normal Direction at Reduced Velocity—Rotation in Normal Direction a Referring to FIG. 16, in this embodiment, after ending the rotation of the photosensitive drum 1 in the normal direction a at the normal velocity at the end of a given printing job, the photosensitive drum 1 is rotated in reverse. Thereafter, the photosensitive drum 1 is rotated in the normal direction a at ¼ the normal velocity in order to disperse the agglutinated residual developer and/or external additive, during the initial stage of the startup of the image forming apparatus for the next image formation job. After the photosensitive drum 1 is rotated in the normal direction a at ¼ the normal velocity during the initial stage of the startup of the image forming apparatus for the next image formation job, the photosensitive drum 1 is continuously rotated in the normal direction a at the normal velocity for image formation.

FIG. 16(1) shows the state of the contact area, and its adjacencies, between the cleaning edge of the cleaning blade 6*a* and the photosensitive drum 1 being rotated in the normal direction a for image formation. In this state, the cleaning edge of the cleaning blade 6*a* is deformed. This deformation occurs for the following reason. That is, because the cleaning blade 6*a* is tilted so that its cleaning edge counters the movement of the peripheral surface of the photosensitive drum 1 in the normal direction a. Therefore, the cleaning edge of the cleaning blade 6*a* is dragged by the peripheral surface of the photosensitive drum 1. With the cleaning edge of the cleaning blade 6*a* deformed, the residual developer and/or external additive t removed from the peripheral surface of the photosensitive drum 1 is likely to be moved into the gap between the deformed cleaning edge of the blade 6*a* and the peripheral surface of the photosensitive drum 1 as it is moved in the normal rotational direction a of the photosensitive drum 1 by the movement of the peripheral surface of the photosensitive drum 1.

FIG. 16(2) is the state of the contact area, and its adjacencies, between the blade 6*a* and the peripheral surface of the photosensitive drum 1 at the moment the photosensitive drum 1 began to be rotated in the reverse direction b. The lump of the residual developer and/or external additive t having had collected between the blade 6*a* and photosensitive drum 1 has been agglutinated by the pressure F generated as the resiliency of the blade 6*a* causes the deformed portion of the cleaning edge of the blade 6*a* to kick.

FIG. 16(3) shows the state of the contact area, and its adjacencies, between the blade 6*a* and photosensitive drum 1 after the rotation of the photosensitive drum 1 in the reverse direction b. The peripheral velocity of the photosensitive drum 1 during this reverse rotation is 100 mm/sec, which is the same as that at which the photosensitive drum 1 is rotated in the normal direction a. The length of the reversal rotation of the photosensitive drum 1 is 400 msec. In this state, the lump of the agglutinated residual developer and/or external additive t remains adhered fast to the peripheral surface of the photosensitive drum 1 even after it was moved away from the contact area between the blade 6*a* and photosensitive drum 1. While the photosensitive drum 1 is kept still after the reverse rotation of the photosensitive drum 1, the residual developer and/or external additive t does not solidly adhere to the portion of the peripheral surface of the photosensitive drum 1, which is in contact with the cleaning edge of the blade 6*a* while the photosensitive drum 1 is kept still. After the reversal rotation of the photosensitive drum 1 allowed the deformed portion of the cleaning edge of the blade 6*a* to snap back into the pre-deformation shape, the pressure the blade 6*a* generates as it is kept pressed against the peripheral surface of the photosensitive drum 1 is not large enough to cause the lump of the residual developer and/or external additive t to agglutinate. Therefore, as long as the photosensitive drum 1 is briefly rotated in the reverse direction b immediately after the completion of the image forming rotation of the photosensitive drum 1 in the normal direction a at the end of a given printing job, even if the photosensitive drum 1 is kept still for a substantial length of time, the agglutination of the residual developer and/or external additive t does not occur in the contact area. Therefore, this reversal rotation of the photosensitive drum 1 does not result in the formation of an image having the parallel blurry strips, the locations of which correspond to the contact area between the blade 6*a* and photosensitive drum 1 after the reversal rotation.

As will be evident from the above description of this embodiment, at the end of the image forming rotation of the photosensitive drum 1 in the normal direction a, a small lump of the residual developer and/or external additive t is present in the gap between the blade 6*a* and photosensitive drum 1. Therefore, if the rotation of the photosensitive drum 1 in the reverse direction b is started immediately after the end of the image forming rotation of the photosensitive drum 1 in the normal direction a, the small lump of the residual developer and/or external additive t is instantly agglutinated (FIG. 16(2)) by the pressure generated by the resiliency of the blade 6*a* as the deformed portion of the cleaning edge of the blade 6*a* is allowed to kick by the rotation of the photosensitive drum 1 in the reverse direction b. However, after the rotation of the photosensitive drum 1 in the reverse direction b, the cleaning edge of the blade 6*a*, which is in contact with the peripheral surface of the photosensitive drum 1 is not deformed. It is evident, therefore, that after the rotation of the photosensitive drum 1 in the reverse direction b, the agglutination of the residual developer and/or external additive t does not occur in the contact area.

Thus, in fourth embodiment (Embodiment 3-1), in order to disperse, at the beginning of the next printing job, the lump of the residual developer and/or external additive t which was agglutinated and adhered to the peripheral surface of the photosensitive drum 1 during the brief rotation of the photosensitive drum 1 in the reverse direction b, the photosensitive drum 1 is rotated in the normal direction a at a reduced peripheral velocity, at the beginning of the image forming rotation of the photosensitive drum 1 for the next printing job. FIG. 16(4) shows the state of the contact area, and its adjacencies, between the blade 6*a* and the photosensitive drum 1 at the very beginning of the next printing job.

From the point in time corresponding to this state of the contact area, the photosensitive drum 1 is rotated at a reduced peripheral velocity of 25 mm/sec for 2,500 msec. The duration of this rotation of the photosensitive drum 1 at the reduced peripheral velocity needs to be longer than the duration of the reversal rotation of the photosensitive drum 1 started at the point in time corresponding to the state of the contact area shown in FIG. 16(3). In this embodiment, the peripheral velocity at which the photosensitive drum 1 is rotated in the reverse direction b is ¼ the normal peripheral velocity. Therefore, the length of time the photosensitive drum 1 is to be rotated in the normal direction a at ¼ the normal peripheral velocity must be no less than four times the length of time (400 msec) the photosensitive drum 1 is rotated in the reverse direction b. In other words, the length of time the photosensitive drum 1 is to be rotated in the normal direction a at the reduced peripheral velocity must be no less than 1,600 msec. As the photosensitive drum 1 is rotated in the normal direction a at the reduced peripheral velocity, the lump t of the agglutinated residual developer and/or external additive is moved past the blade 6*a*, while being loosened and dispersed across the area wider than the contact area, as shown in FIG. 16(5). In other words, during the rotation of the photosensitive drum 1 in the normal direction a at the reduced peripheral velocity, the agglutinated residue t is loosened up and spread across the wider area of the peripheral surface of the photosensitive drum 1 than the area of the peripheral surface of the photosensitive drum 1 to which they were adhered at the very beginning of the brief reverse rotation of the photosensitive drum 1, by the rotation of the photosensitive drum 1 in the normal direction a at the reduced peripheral velocity. With the addition of this step in which the photosensitive drum 1 is rotated in the normal direction a at the reduced peripheral velocity, the parallel blurry strips, from which an image formed by the image forming apparatus in this embodiment suffers, are virtually inconspicuous, because the area of the peripheral surface of the photosensitive drum 1, which is different in coefficient of friction from the rest of the peripheral surface of the photosensitive drum 1, is widened by the rotation of the photosensitive drum 1 in the normal direction a at the reduced peripheral velocity, and therefore, the resultant image aberration attributable to the changes in the peripheral velocity of the photosensitive drum 1 is less conspicuous. After the rotation of the photosensitive drum 1 in the normal direction a at the reduced peripheral velocity, the photosensitive drum 1 is rotated in the normal direction a at the normal peripheral velocity to carry out the next printing job. In this embodiment, the photosensitive drum 1 is not stopped between the step in which the photosensitive drum 1 is rotated in the normal direction a at the reduced peripheral velocity, and the following step in which the photosensitive drum 1 is rotated in the normal direction a at the normal speed for the next image formation job; the photosensitive drum 1 is continuously driven. However, before starting to rotate the photosensitive drum 1 in the normal direction a at the normal peripheral velocity after the rotation of the photosensitive drum 1 in the normal direction a at the reduced peripheral velocity, the photosensitive drum 1 may be temporarily stopped after the residue t is moved past the blade 6*a* by the rotation of the photosensitive drum 1 in the normal direction a at the reduced peripheral velocity. Such an approach is just as effective as the above-described one in this embodiment. If the photosensitive drum 1 is kept still no less than one minute between the step in which the photosensitive drum is rotated in the normal direction a at the reduced peripheral velocity, and the step in which it is rotated in the normal direction a at the normal peripheral velocity for image formation, there is the possibility that the residue t will become agglutinated and adhere to the portion of the peripheral surface of the photosensitive drum 1, in the contact area. Therefore, it is desired that when keeping the photosensitive drum 1 in the normal direction a at the reduced peripheral velocity and that at the normal peripheral velocity, the length of time the photosensitive drum 1 is kept still is set to no more then one minute.

(2) Embodiment 3-2 (Rotation in Normal Direction a—One Second Stop—Rotation in Normal Direction a at Reduced Peripheral Velocity—Rotation in Reverse Direction b—Stop (Left Unattended)—Rotation in Normal Direction a at Reduced Velocity—Rotation in Normal Direction a)

Figure 17:
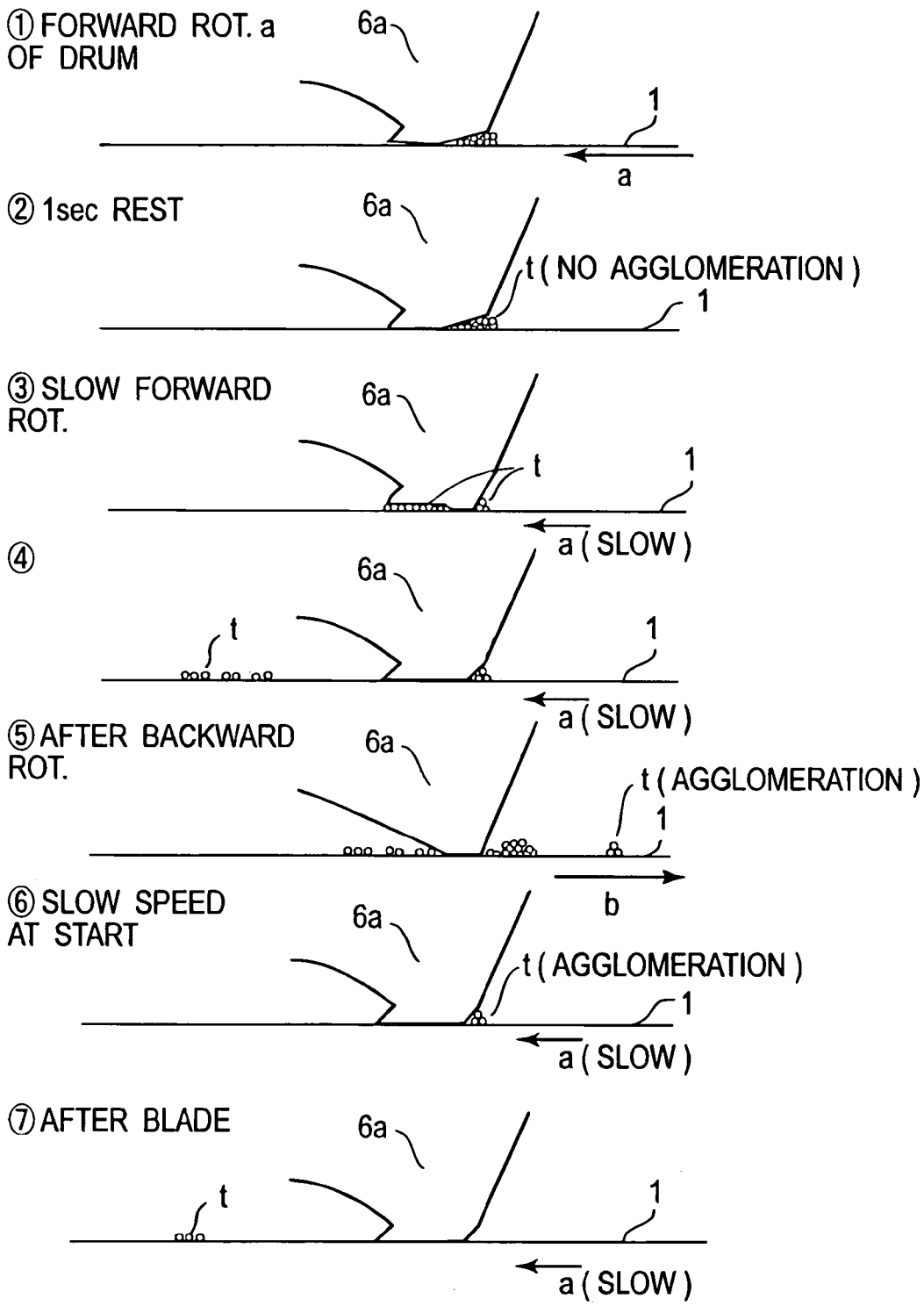
FIG. 17 consisting of parts (1) through (7) is a schematic sectional view of the contact area, and its adjacencies, between the cleaning edge of the cleaning blade and the peripheral surface of the image bearing member, in the fifth embodiment, showing the changes in the state of the cleaning edge, which is caused by the image bearing member rotation control carried out immediately after the completion of a given image forming job.

Referring to FIG. 17, in this embodiment, after the rotation of the photosensitive drum 1 in the normal direction a at the normal peripheral velocity is stopped, the photosensitive drum 1 is stopped for one second, and then, is rotated in the normal direction a at ¼ the normal peripheral velocity. Then, the photosensitive drum 1 is rotated in reverse. Then, during the initial stage of the startup of the image forming apparatus for the next image formation job, the photosensitive drum 1 is rotated in the normal direction a at ¼ the normal peripheral velocity in order to disperse the agglomerated residues. After the photosensitive drum 1 is rotated in the normal direction a at ¼ the normal velocity during the initial stage of the startup of the image forming apparatus for the next image formation job, the photosensitive drum 1 is rotated in the normal direction a at the normal peripheral velocity (constant velocity).

FIG. 17(1) shows the state of the contact area, and its adjacencies, between the cleaning edge of the cleaning blade 6*a* and the photosensitive drum 1 being rotated in the normal direction a for image formation. In this case, the cleaning edge of the cleaning blade 6*a* is deformed. This deformation occurs for the following reason. That is, because the cleaning blade 6*a* is tilted so that its cleaning edge counters the movement of the peripheral surface of the photosensitive drum 1 in the normal direction a. Therefore, the cleaning edge of the cleaning blade 6*a* is dragged by the peripheral surface of the photosensitive drum 1. With the cleaning edge of the cleaning blade 6*a* deformed, the residual developer and/or external additive t having just been removed from the peripheral surface of the photosensitive drum 1 is likely to be moved into the gap between the deformed cleaning edge of the blade 6*a* and the peripheral surface of the photosensitive drum 1 as it is moved in the normal rotational direction a of the photosensitive drum 1 by the movement of the peripheral surface of the photosensitive drum 1.

FIG. 17(2) shows the state of the contact area, and its adjacencies, between the blade 6*a*, and photosensitive drum 1, the rotation of which in the normal direction a has been stopped. In this state, as long as the length of time the photosensitive drum is kept still is no more than one minute, the lump of the developer and/or external additive t is not agglutinated. In this embodiment, the photosensitive drum 1 is kept still for one second.

FIG. 17(3) shows the state of the contact area, and its adjacencies, between the blade 6*a* and photosensitive drum 1 being rotated in the normal direction a at a reduced peripheral velocity, that is, 25 mm/sec, for 40 msec. In this state, the first printing job has been completed. Therefore, it is unnecessary to remove the residual developer, and the inertia of the developer and/or external additive t, which acts in the direction to move the developer and/or external additive t into the gap between the cleaning edge of the blade 6*a* and the photosensitive drum 1, is virtually gone because of the reduction in the peripheral velocity of the photosensitive drum 1. In addition, the photosensitive drum 1 is rotated at the reduced peripheral velocity, making it easier for the blade 6*a* to flawlessly contact the peripheral surface of the photosensitive drum 1. As a result, the blade 6*a* is placed in contact with the peripheral surface of the photosensitive drum 1, with the presence of virtually no gap, making it difficult for the residual developer and/or external additive t to enter the interface between the cleaning edge of the blade 6*a* and the peripheral surface of the photosensitive drum 1.

FIG. 17(4) shows the state of the contact area between the blade 6*a* and photosensitive drum 1, and its adjacencies, after the photosensitive drum 1 was rotated at ¼ the normal peripheral velocity. In this state, the developer and/or external additive t having had stuck in the gap between the blade 6*a* and photosensitive drum 1 has been moved out downward of the contact area by the movement of the peripheral surface of the photosensitive drum 1. The width of the contact area W (nip), in terms of the rotational direction of the photosensitive drum 1, between the blade 6*a* and photosensitive drum 1 is roughly 500 μm, and the distance by which the peripheral surface of the photosensitive drum 1 of the image forming apparatus in this embodiment was moved was 25×60=1500 (μm), which was long enough to move the residual developer and/or external additive t having had stuck in the gap between the blade 6*a* and photosensitive drum 1 out downward of the contact area W (nip).

FIG. 17(5) shows the state of the contact area, and its adjacencies, between the blade 6*a* and photosensitive drum 1 after the photosensitive drum 1 was rotated in the reverse direction b. The peripheral velocity at which the photosensitive drum 1 was rotated in the reverse direction b was 100 mm/sec, which was the same as that of the normal rotation, and the duration of this reverse rotation was 400 msec. In this state, there is virtually no residual developer and/or external additive t stuck between the blade 6*a* and photosensitive drum 1. Therefore, the agglutination of the residual developer and/or external additive t does not occur even though the deformed cleaning edge of the blade 6*a* kicks as it snaps back into the natural shape as the photosensitive drum 1 is rotated in the reverse direction b. The small lump of the residual developer and/or external additive t which was next to the upstream edge of the contact area between the blade 6*a* and photosensitive drum 1, in terms of the normal rotational direction a of the photosensitive drum 1, before the reverse rotation of the photosensitive drum 1, had not become agglutinated. Therefore, as it was moved away from the contact area, it crumbled into smaller lumps, and did not firmly adhere to the peripheral surface of the photosensitive drum 1.

In this embodiment, or the fifth example (Embodiment 3-2), in order to further disperse the smaller lumps of residual developer and/or external additive t having resulted from the crumbling of the small lump of residual developer and/or external additive t, the photosensitive drum 1 is rotated in the normal direction a at a reduced peripheral velocity at the beginning of the next printing job. FIG. 17(6) shows the state of the contact area, and its adjacencies, between the blade 6*a* and the photosensitive drum 1 at the very beginning of the next printing job. From the point in time corresponding to this state of the contact area, the photosensitive drum 1 is rotated at a reduced peripheral velocity of 25 mm/sec for 2,500 msec. The duration of this rotation of the photosensitive drum 1 needs to be longer than the duration of the reversal rotation of the photosensitive drum 1 started at the point in time corresponding to the state of the contact area shown in FIG. 17(5). In this embodiment, the peripheral velocity at which the photosensitive drum 1 is rotated in the revers direction b is ¼ the normal peripheral velocity. Therefore, the length of time the photosensitive drum 1 is to be rotated in the normal direction a at ¼ the normal peripheral velocity must be no less than four times the length of time (400 msec) the photosensitive drum 1 is rotated in the reverse direction b. In other words, the length of time the photosensitive drum 1 is to be rotated in the normal direction a at the reduced peripheral velocity must be no less than 1,600 msec. As the photosensitive drum 1 is rotated in the normal direction a at the reduced peripheral velocity, the small lump of residual developer and/or external additive is moved past the blade 6*a*, while being dispersed across the area wider than the contact area, as shown in FIG. 17(7). In other words, during the rotation of the photosensitive drum 1 in the normal direction a at the reduced peripheral velocity, the residue t is spread across the wider area of the peripheral surface of the photosensitive drum 1 than the area of the peripheral surface of the photosensitive drum 1 on which it was at the very beginning of the reverse rotation of the photosensitive drum 1, by the rotation of the photosensitive drum 1 in the normal direction a at the reduced peripheral velocity. With the addition of this step of rotating the photosensitive drum 1 in the normal direction a at the reduced peripheral velocity, the image aberrations, or the parallel blurry strips, from which an image formed by the image forming apparatus in this embodiment suffers are virtually inconspicuous, because the area of the peripheral surface of the photosensitive drum 1, which is different in coefficient of friction from the rest of the peripheral surface of the photosensitive drum 1, is widened by the rotation of the photosensitive drum 1 in the normal direction a at the reduced peripheral velocity, and therefore, the resultant image aberration attributable to the changes in the peripheral velocity of the photosensitive drum 1 is less conspicuous. After the rotation of the photosensitive drum 1 in the normal direction a at the reduced peripheral velocity, the photosensitive drum 1 is rotated in the normal direction a at the normal peripheral velocity (constant velocity) to carry out the next printing job.

Miscellaneous

1) The latent image bearing member and intermediary transfer member, as image bearing members, may be in the form of a drum or an endless belt. The latent image bearing member may be an electrostatically recordable dielectric member. The image bearing member is a member capable of bearing a toner image (developer image) formed thereon with the use of one of various image forming means.

2) The toners used as developer by the image forming apparatuses in the above-described embodiments are spherical toners with an average particle diameter of 6 μm, as described above. Following are the definitions of the method for measuring the average particle diameter of toner, and the definition of spherical toner.

1. Method for Measuring Average Particle Diameter of Toner

The apparatus used for the measurement is a Coulter Counter TA-2 (product of Coulter Co., Ltd.), to which an interface (product of Nikkaki Co., Ltd.) which outputs number average distribution and volume average distribution, and a personal computer CX-1 (Canon Inc.), are connected. The electrolyte is 1% water solution of first class sodium chloride (NaCl).

As for the measuring method, 0.1–5 ml of surfactant, preferably, alkylbenzene sulfonate, as dispersant, is added to 100–150 ml of the aforementioned electrolytic water solution, and then, 0.5–50 mg of test sample is added to the mixture.

The electrolyte in which the test sample is suspended is processed with an ultrasonic dispersing device, for roughly one to three minutes to disperse the test sample. Then, the number and volume average distributions of the toner particles, the diameters of which are in the range of 2–40 μm, are obtained with the use of the abovementioned Coulter Counter TA-2 fitted with a 100 μm aperture. Then, from these distributions, the volume average particles diameter is obtained.

2. Spherical Toner

As the shape factors for indicating the sphericity of a toner particle, SF-1 and SF2 are used. SF-1 indicates the roundness of a particle. The SF-1 of a perfectly spherical particle is 100. The greater the SF-1 of a particle, the more irregular the shape of the particle. SF-2 indicates the degree of roughness of the surface of a particle. The SF-2 of a particle, the surface of which is perfectly smooth is 100. The greater the SF-2 of a particle, the rougher the surface of a particle.

The values of the SF-1 and SF-2 of spherical toner are desired to satisfy the following requirements:

SF-1=100–160

SF-2=100–140, preferably,

SF-1=100–140

SF-2=100–120.

Figure 18:
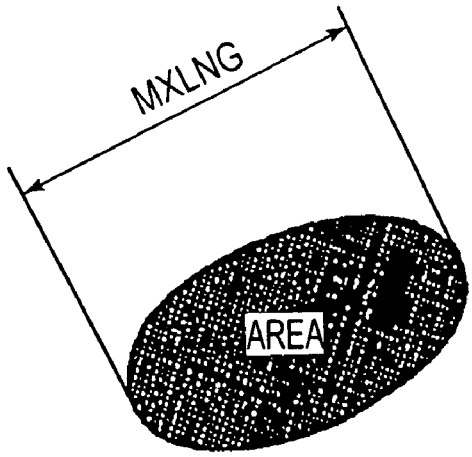
FIG. 18 is a drawing describing the shape factor (SF-1) of a toner particle.

The values of the SF-1 and SF-2 of the spherical toner used by the image forming apparatuses in accordance with the present invention are those obtained with the use of the following instruments and formulas. The instruments are FE-SEM (S-800) (product of Hitachi, Ltd.), which are used to enlarge the toner image by 500 times to randomly sample 100 toner particles. The obtained video data are inputted into an image analyzing apparatus LUZEX 3 (product of Nikore Co., Ltd.) and analyzed. Then, the values of the SF-1 and SF-2 are calculated using the following equations (FIGS. 18 and 19):

$$SF\text{-}1=\{(MXLNG)^2/\mathrm{AREA}\}\times(p/4)\times 100$$

$$SF\text{-}2=\{(PERI)^2/\mathrm{AREA}\}\times(1/4p)\times 100$$

AREA: projected area of toner particle

MXLNG: absolute maximum length

PERI: circumference

As described above, according to one of the characteristic aspects of this embodiment, the image bearing member is temporarily stopped after the completion of a given image formation job, and then, the image bearing member is briefly rotated, while keeping the cleaning blade in contact with the peripheral surface of the image bearing member, removing the small lump of residual developer and/or external additive having being trapped in the gap between the cleaning blade and peripheral surface of the image bearing member. Then, the image bearing member is rotated in the reverse direction in order to prevent the small lump of residual developer and/or external additive from being agglutinated, and also, to allow the cleaning blade to recover from the deformation, preventing thereby the residual developer and/or external additive from being agglutinated by the pressure applied by the blade while the image bearing member is not rotated. Therefore, it is possible to inexpensively reduce the load changes attributable to the local reduction in the coefficient of the surface friction of the peripheral surface of the image bearing member, making it possible to always output an image of good quality, more specifically, an image which does not suffer from parallel blurry strips attributable to the changes in the peripheral velocity of the peripheral surface of the image bearing member which occur during the exposure process.

According to another characteristic aspect of this embodiment, an image of good quality, in practical terms, can be obtained without providing the image forming apparatus with an apparatus for placing the cleaning member in contact with the peripheral surface of the image bearing member, or moving the cleaning member away therefrom. In other words, it is possible to eliminate from the image forming apparatus, the mechanism for placing the cleaning member in contact with the peripheral surface of the image bearing member, or moving the cleaning member away therefrom, making it possible not only to substantially reduce the cost of an image forming apparatus, but also, to improve in reliability an image forming apparatus. Further, all that is required by this embodiment is to control the rotation of the image bearing member immediately prior to the starting of a given printing job. Therefore, not only can this embodiment substantially reduces the amount of electric power consumed by an image forming apparatus during the standby period, but also, it can eliminate the noises attributable to the brief movements of the cleaning member during the standby period.

In addition, compared to the method, in accordance with the prior art, for controlling the rotation of the image bearing member, according to which an image bearing member is briefly rotated every predetermined length of time during the standby period, in particular, the long standby period, the control method in this embodiment can substantially extend the service life of the image bearing member, hence, the service life of the image forming apparatus.

As will be evident from the description of the preceding embodiments of the present invention, according to the present invention, the problem that the residual developer and/or the like is agglutinated by the cleaning blade is prevented by rotating the image bearing member in the normal direction by a predetermined peripheral distance of the image bearing member, in terms of the rotational direction of the image bearing member, before rotating the image bearing member in the reverse direction. Therefore, the problem that the coefficient of friction of the peripheral surface of the image forming apparatus is locally reduced by the agglutination of the developer and/or the like can be prevented. Therefore, the changes in the amount of the load produced by the cleaning blade or the like as the image bearing member is rotated is minimized, which in turn minimizes the fluctuation in the peripheral velocity of the image bearing member. Therefore, the formation of an image suffering from image defects, in particular, the parallel blurry strips, can be prevented.

Further, the present invention prevents the agglutination of the developer and/or the like, by controlling the rotation of the image bearing member, instead of moving the cleaning blade away from the peripheral surface of the image bearing member, making unnecessary the mechanism for temporarily moving the cleaning blade away from the peripheral surface of the image bearing member to prevent the agglutination; the present invention can simplify the solution to the agglutination of the developer and/or the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 208004/2003 filed Aug. 20, 2003, which is hereby incorporated by reference.

What is claimed is:

1. An image forming apparatus for forming an image on a recording material, said apparatus comprising:

a rotatable image bearing member;

a developing member for developing a latent image formed on said image bearing member;

a cleaning blade for removing a developer from said image bearing member, said cleaning blade being cooperative with said image bearing member to form a nip in which said cleaning blade is contacted to said image bearing member within a predetermined area; and a controller for executing a first step of stopping rotation of said image bearing member after completion of an image forming operation for forming an image on the recording material; a second step of rotating, after the first step, said image bearing member through a predetermined peripheral distance in a rotational direction which is the same as a direction in which said image bearing member is rotated during the image forming operation; a third step of rotating, after the second step, said image bearing member in a rotational direction which is opposite the direction in which said image bearing member is rotated during the image forming operation; and a fourth step of stopping rotation of said image bearing member after the third step.

2. An apparatus according to claim 1, wherein said cleaning blade is contacted to said image bearing member counter directionally with respect to the rotational direction during the image forming operation.

3. An apparatus according to claim 1, wherein a peripheral speed of said image bearing member in the second step is lower than a peripheral speed thereof during the image forming operation.

4. An apparatus according to claim 1, wherein a time period from a stop of rotation of said image bearing member in the first step to a start of rotation of said image bearing member in the second step is shorter than a time period required, in the image forming operation, for a rotational speed of said image bearing member to reach a predetermined speed.

5. An apparatus according to claim 1, wherein a peripheral distance through which said image bearing member rotates in the third step is shorter than a distance between the nip and a contact position where an image transfer means is contacted to said image bearing member, said image transfer means being effective to transfer a developed image formed on said image bearing member onto the recording material.

6. An apparatus according to claim 1, wherein during a period of time from a start of rotation of said image bearing member in the third step to a stop of rotation of said image bearing member in the fourth step, said developing member is spaced away from said image bearing member, or said developing member is kept non-rotating.

7. An apparatus according to claim 1, wherein said image bearing member is at rest for not more than 1 minute in the first step.

8. An apparatus according to claim 1, wherein said image bearing member is an electrophotographic photosensitive drum.

9. An apparatus according to claim 1, further comprising an intermediary transfer member in the form of an endless belt, wherein said intermediary transfer member is effective to temporarily carry the developed image transferred thereonto and wherein the developed image is then transferred onto the recording material.

10. An apparatus according to claim 1, further comprising a process cartridge detachably mountable to a main assembly of said apparatus, wherein said process cartridge contains an electrophotographic photosensitive drum functioning as said image bearing member, a developing roller functioning as said developing member, and said cleaning blade.

11. An apparatus according to claim 1, wherein the predetermined distance is not less than a width of the nip.

12. A control method for an image bearing member for an image forming apparatus for forming an image on a recording material, the image forming apparatus including the image bearing member, a developing member for developing a latent image formed on the image bearing member, a cleaning blade for removing a developer from the image bearing member, the cleaning blade being cooperative with the image bearing member to form a nip in which the cleaning blade is contacted to the image bearing member within a predetermined area, said method comprising:

a first step of stopping rotation of the image bearing member after completion of an image forming operation for forming an image on the recording material;

a second step of rotating, after the first step, the image bearing member through a predetermined peripheral distance in a rotational direction which is the same as a direction in which the image bearing member is rotated during the image forming operation;

a third step of rotating, after the second step, the image bearing member in a rotational direction which is opposite the direction in which the image bearing member is rotated during the image forming operation; and a fourth step of stopping rotation of the image bearing member after said third step.

13. A method according to claim 12, wherein a peripheral speed of the image bearing member in said second step is lower than a peripheral speed thereof during the image forming operation.

14. A method according to claim 12, wherein a time period from a stop of rotation of the image bearing member in said first step to a start of rotation of the image bearing member in said second step is shorter than a time period required, in the image forming operation, for a rotational speed of the image bearing member to reach a predetermined speed.

15. A method according to claim 12, wherein a peripheral distance through which the image bearing member rotates in said third step is shorter than a distance between the nip and a contact position where image transfer means is contacted to the image bearing member, the image transfer means being effective to transfer a developed image formed on the image bearing member onto the recording material.

16. A method according to claim 12, wherein during a period of time from a start of rotation of the image bearing member in said third step to a stop of rotation of said image bearing member in said fourth step, the developing member is spaced away from the image bearing member, or the developing member is kept non-rotating.

17. A method according to claim 12, wherein the image bearing member is at rest for not more than 1 minute in said first step.

18. A method according to claim 12, wherein the predetermined distance is not less than a width of the nip.

* * * * *

UNITED STATES PATENT AND TRADEMARK OFFICE

CERTIFICATE OF CORRECTION

PATENT NO. : 7,120,376 B2
APPLICATION NO. : 10/919401
DATED : October 10, 2006
INVENTOR(S) : Masanobu Saito et al.

It is certified that error appears in the above-identified patent and that said Letters Patent is hereby corrected as shown below:

ON THE TITLE PAGE, AT ITEM (56), RC:
Other Publications, after Patent Abstracts (all occurrences): "58192056," should read --58-192056,--; "60128463," should read --60-128463,--; and "61067056," should read --61-067056,--.

SHEET NO. 14 of 17:
Figure 15, "MOVEMEBT" should read --MOVEMENT--.

Figure 19:
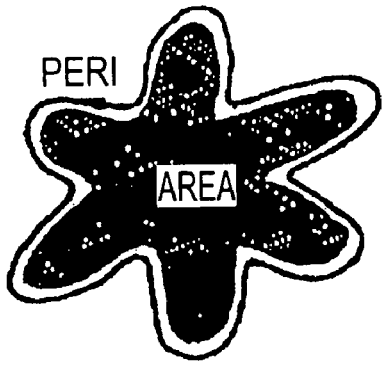
FIG. 19 is a drawing for describing the shape factor (SF-2) of a toner particle.

SHEET NO. 17 of 17:
Figure 19, "$(MXLIG)^{2}$" should read --$(MXLNG)^{2}$--.

COLUMN 1:
Line 8, "electrophotographic" should read --electrophotographic or electrostatic--.

COLUMN 5:
Line 61, "is" should read --does--.
Line 63, "an" should read --a--.

Figure 11:
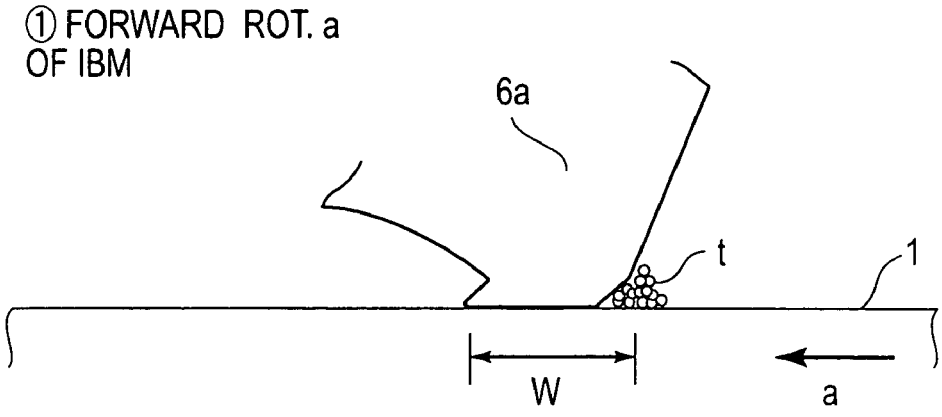
FIG. 11 consisting of parts (1) and (2) is a schematic sectional view of the contact area, and its adjacencies, between the cleaning edge of the cleaning blade and the peripheral surface of the image bearing member of an image forming apparatus in accordance with the prior art, showing the changes in the state of the cleaning edge, which is caused by the image bearing member rotation control carried out immediately after the completion of a given image forming job.
Figure 11:
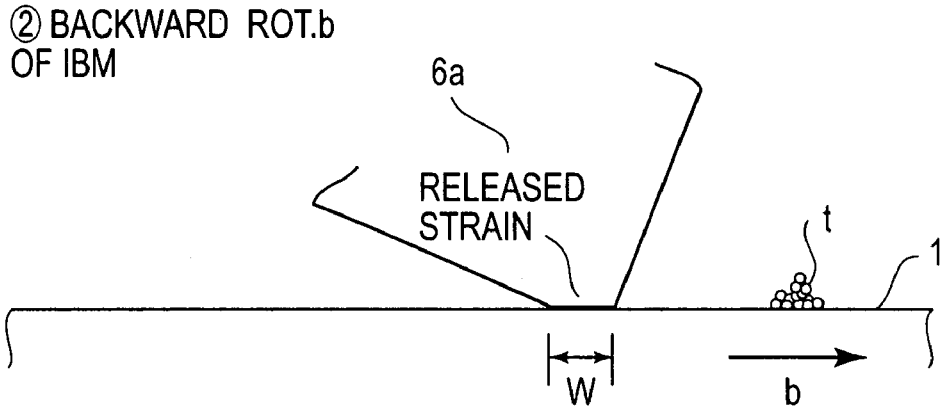

COLUMN 6:
Line 13, "3," should read --(3),--.
Line 34, "FIG. 11 consisting of parts (1) and (2)" should read --FIG. 11, consisting of parts (1) and (2),--.
Line 55, "FIG. 16 consisting of parts (1) through (5)" should read --FIG. 16, consisting of parts (1) through (5),--.
Line 63, "FIG. 17 consisting of parts (1) through (7)" should read --FIG. 17, consisting of parts (1) through (7),--.

COLUMN 11:
Line 35, "prevent" should read --preventing--.

COLUMN 13:
Line 39, "shown" should read --shows--; and "immediate" should read --immediately--.

COLUMN 15:
Line 11, "immediate" should read --immediately--.

COLUMN 16:
Line 45, "generates" should read --generate--.

COLUMN 20:
Line 2, "Eecond" should read --Second--.

UNITED STATES PATENT AND TRADEMARK OFFICE

CERTIFICATE OF CORRECTION

PATENT NO. : 7,120,376 B2
APPLICATION NO. : 10/919401
DATED : October 10, 2006
INVENTOR(S) : Masanobu Saito et al.

It is certified that error appears in the above-identified patent and that said Letters Patent is hereby corrected as shown below:

COLUMN 22:
Line 63, “scraped of” should read --scraped off--.

COLUMN 23:
Line 64, “wide W.” should read --width W.--.

COLUMN 24:
Line 31, “above” should read --above--.
Line 49, “the” should be deleted.

COLUMN 25:
Line 1, “residues” should read --residue--.
Line 2, “are” should read --is--.
Line 5, “residues” should read --residue--.
Line 9, “are” should read --is--.
Line 14, “is” should be deleted.

COLUMN 28:
Line 6, “drum 1” should read --drum 1 still between the rotation of the photosensitive drum 1--.
Line 9, “then” should read --than--.

COLUMN 30:
Line 4, “revers” should read --reverse--.

COLUMN 31:
Line 17, “SF2” should read --SF-2--.

COLUMN 32:
Line 24, “reduces” should read --reduce--.

COLUMN 33:
Line 34, “counter directionally” should read --counterdirectionally--.

UNITED STATES PATENT AND TRADEMARK OFFICE

CERTIFICATE OF CORRECTION

PATENT NO. : 7,120,376 B2
APPLICATION NO. : 10/919401
DATED : October 10, 2006
INVENTOR(S) : Masanobu Saito et al.

It is certified that error appears in the above-identified patent and that said Letters Patent is hereby corrected as shown below:

COLUMN 34:
Line 45, "in the" should read --in a--.

Signed and Sealed this

Thirty-first Day of July, 2007

JON W. DUDAS
*Director of the United States Patent and Trademark Office*